US009421599B2

(12) United States Patent
Sawdon et al.

(10) Patent No.: US 9,421,599 B2
(45) Date of Patent: Aug. 23, 2016

(54) CLINCH CLAMP

(75) Inventors: Stephen E. Sawdon, Marysville, MI (US); Brian D. Petit, Algonac, MI (US); Steven J. Sprotberry, Marysville, MI (US)

(73) Assignee: BTM Company LLC MI (US)

( * ) Notice: Subject to any disclaimer, the term of this patent is extended or adjusted under 35 U.S.C. 154(b) by 1317 days.

(21) Appl. No.: 13/296,297

(22) Filed: Nov. 15, 2011

(65) Prior Publication Data

US 2012/0117773 A1 May 17, 2012

Related U.S. Application Data

(60) Provisional application No. 61/414,229, filed on Nov. 16, 2010.

(51) Int. Cl.
*B21D 39/03* (2006.01)

(52) U.S. Cl.
CPC ..... *B21D 39/031* (2013.01); *Y10T 29/53996* (2015.01)

(58) Field of Classification Search
CPC ..... B27F 7/155; B27F 1/00; B21F 27/20
See application file for complete search history.

(56) References Cited

U.S. PATENT DOCUMENTS

| | | | | |
|---|---|---|---|---|
| 3,534,896 | A | 10/1970 | Speller et al. | |
| 4,035,901 | A | 7/1977 | Lux et al. | |
| 4,759,109 | A | 7/1988 | Mason et al. | |
| 4,955,119 | A | 9/1990 | Bonomi et al. | |
| 4,967,947 | A | 11/1990 | Sarh | |
| 5,060,839 | A * | 10/1991 | Seki | A41H 37/10 227/119 |
| 5,169,047 | A | 12/1992 | Endres et al. | |
| 5,581,860 | A | 12/1996 | Sawdon | |
| 5,713,116 | A * | 2/1998 | Nickerson | B23P 19/062 29/243.518 |
| 5,782,130 | A | 7/1998 | Sawdon | |
| 6,062,458 | A | 5/2000 | Edwards | |
| 6,092,270 | A | 7/2000 | Sawdon | |
| 6,115,898 | A * | 9/2000 | Sawdon | B25B 5/087 269/233 |
| 6,360,415 | B1 * | 3/2002 | Wada | B21D 41/02 29/281.1 |
| 7,591,054 | B2 * | 9/2009 | Baughman | B21D 51/40 29/243.5 |
| 2001/0039718 | A1 | 11/2001 | Mauer et al. | |
| 2004/0143948 | A1 * | 7/2004 | Rapp | B21D 39/031 29/283.5 |
| 2004/0168294 | A1 | 9/2004 | Malaka | |
| 2005/0132563 | A1 | 6/2005 | Schmidt | |

(Continued)

FOREIGN PATENT DOCUMENTS

| | | | |
|---|---|---|---|
| DE | 102004002974 | A1 | 8/2005 |
| DE | 102004040606 | B3 | 1/2006 |

(Continued)

OTHER PUBLICATIONS

European Search Report for Application No. EP 11 18 9451 dated Jan. 26, 2012.

(Continued)

*Primary Examiner* — Lee D Wilson
(74) *Attorney, Agent, or Firm* — Harness, Dickey & Pierce, P.L.C.

(57) ABSTRACT

An apparatus for clinching a workpiece is provided. The apparatus generally includes a clamp body, an arm, a punch, a die and a first linear actuator. The arm is rotatably fixed to the clamp body around a first pivot axis between a closed position and an open position. The punch is mounted to one of the body and the arm.

43 Claims, 17 Drawing Sheets

(56) References Cited

U.S. PATENT DOCUMENTS

| | | | | |
|---|---|---|---|---|
| 2006/0027541 | A1 | 2/2006 | Sun et al. | |
| 2008/0276444 | A1 | 11/2008 | Condliff | |
| 2008/0277953 | A1 | 11/2008 | Condliff | |
| 2012/0117773 | A1 * | 5/2012 | Sawdon ..... | B21D 39/031 29/283.5 |
| 2012/0260491 | A1 | 10/2012 | Draht et al. | |

FOREIGN PATENT DOCUMENTS

| | | | |
|---|---|---|---|
| DE | 102007020167 | A1 | 11/2008 |
| EP | 0243599 | A2 | 11/1987 |
| FR | 357845 | A | 1/1906 |
| GB | 2450206 | | 12/2009 |
| WO | WO-9218264 | A1 | 10/1992 |
| WO | WO-9402267 | A1 | 2/1994 |
| WO | WO-02078892 | A1 | 10/2002 |
| WO | WO-2004045787 | A1 | 6/2004 |
| WO | WO-2008131880 | A1 | 11/2008 |

OTHER PUBLICATIONS

International Search Report and Written Opinion for PCT Application No. PCT/EP2010/006272 mailed Jun. 14, 2011, 26 pages.

* cited by examiner

CLINCH CLAMP

CROSS-REFERENCE TO RELATED APPLICATIONS

This application claims the benefit of U.S. Provisional Application No. 61/414,229, filed on Nov. 16, 2010. The entire disclosure of the above application is incorporated herein by reference.

BACKGROUND AND SUMMARY

The present invention relates generally to a joint forming apparatus and more specifically to a die and punch and related method for forming a joint between sheets of material.

In the manufacture of products, there is often a need to join a pair or several pieces of material, such as sheet metal to build various assemblies and subassemblies. There are many different means for accomplishing this joining task. For example, there is adhesive bonding, welding or cold deformation. Both bonding and welding processes require the introduction of a foreign material to the assembly. The foreign material can tend to fail, thereby weakening the assembly. In cold deformation, several pieces of sheet material are plastically deformed in such a manner that they are locked together. Depending on the thickness, strength and/or the number of pieces of material to be joined, a great amount of force is required to accomplish this task.

Traditional presses for providing this force include in-line hydraulic presses and accordion-type toggle presses. Such presses, however, are often heavy and include many intricate parts making maintenance difficult and time consuming. Furthermore, many presses require a robot to feed (such as horizontally) the pieces of material into a position between a die and punch. Moreover, in many instances it can become difficult and inefficient to manage and accommodate the associated rotational and translational movements of the various components in the press.

In accordance with the present invention, a clamping apparatus is provided. The apparatus generally includes a clamp body, an arm, a punch, a die and a first linear actuator. The arm is rotatably fixed to the clamp body around a first pivot axis between a closed position and an open position. The punch is mounted to one of the body and the arm. The die is fixedly mounted to the other of the body and the arm. The first linear actuator includes a rod that is rotatably coupled to the arm around a second pivot axis. The rod moves between a first position corresponding to the arm being in the closed position and a second position corresponding to the arm being in the open position. A first distance is defined between the first and second pivot axes in the closed position. A second distance is defined between the first and second pivot axes in the open position. The first and second distances are equivalent.

According to additional features of the present invention, the first linear actuator is rotatably fixed to the body about a third pivot axis. The linear actuator rotates around the third pivot axis during translation of the rod between the first and second positions. The arm generally comprises an arcuate body having a first body portion that extends between a first end and the first pivot axis and a second body portion that extends between the second end and the first pivot axis. The first end of the first arm includes one of the punch and die. The second end of the arm includes an engagement member that is configured to contact a portion of the clamp body when the arm rotates to the closed position.

According to additional aspects of the present invention, a second linear actuator is provided on the clamp body. The second linear actuator includes a movable member that moves between a retracted position and an extended position. In the extended position, the movable member is aligned for contact with the second end of the arm and inhibits rotation of the arm around the first pivot axis toward the open position during operation of the punch.

A method for clinching a workpiece with a clamping apparatus is provided. The clamping apparatus is moved to an open position. The workpiece is located between a punch and die oppositely mounted to a clamp body and an arm, respectively, of the clamping apparatus. A rod of a first linear actuator is actuated from a first position to a second position. The arm is caused to rotate relative to the clamp body around a first pivot axis and into a closed position. The rod is rotatably coupled to the arm around a second pivot axis. A first distance is defined between a first and second pivot axes in the closed position and a second distance is defined between the first and second axes in the open position. The first and second distances are equivalent. The punch is then actuated.

According to other aspects of the present invention, the method further comprises contacting an engagement member disposed on the arm with a stop disposed on the clamp body upon rotation of the arm into the closed position. Actuating the rod further comprises rotating the first linear actuator relative to the body about a third pivot axis. According to other aspects of the present invention, the method further comprises actuating a second linear actuator from a first position to a second position causing a movable member to become aligned for contact with the arm prior to actuating the punch. The movable member engages and inhibits rotation of the arm around the first pivot axis toward the open position upon actuation of the punch.

According to other aspects of the present invention, the clamping apparatus is advantageous over conventional clamping devices. In this regard, the clamping apparatus according to the present invention provides a lower cost clamping configuration that requires less moving parts compared to other conventional clamping devices that may incorporate a camming action between a track and follower associated with the arm. Furthermore, the clamping apparatus of the present invention provides a swing arm that rotates around a pivot pin to an open position that allows vertical insertion of workpieces onto the die. The swing arm has a counterbalance body portion that extends opposite the pivot pin relative to the punch assembly to improve balance of the swing arm relative to the clamp body. The configuration of the swing arm, clamp body and first actuator provide an apparatus that accommodates higher loads and has improved balance as compared to conventional clamping devices.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

Corresponding reference numerals indicate corresponding parts throughout the several views of the drawings.

DETAILED DESCRIPTION

The following description of the preferred embodiment is merely exemplary in nature and is in no way intended to limit the scope of the invention, its application, or its uses.

Figure 1:
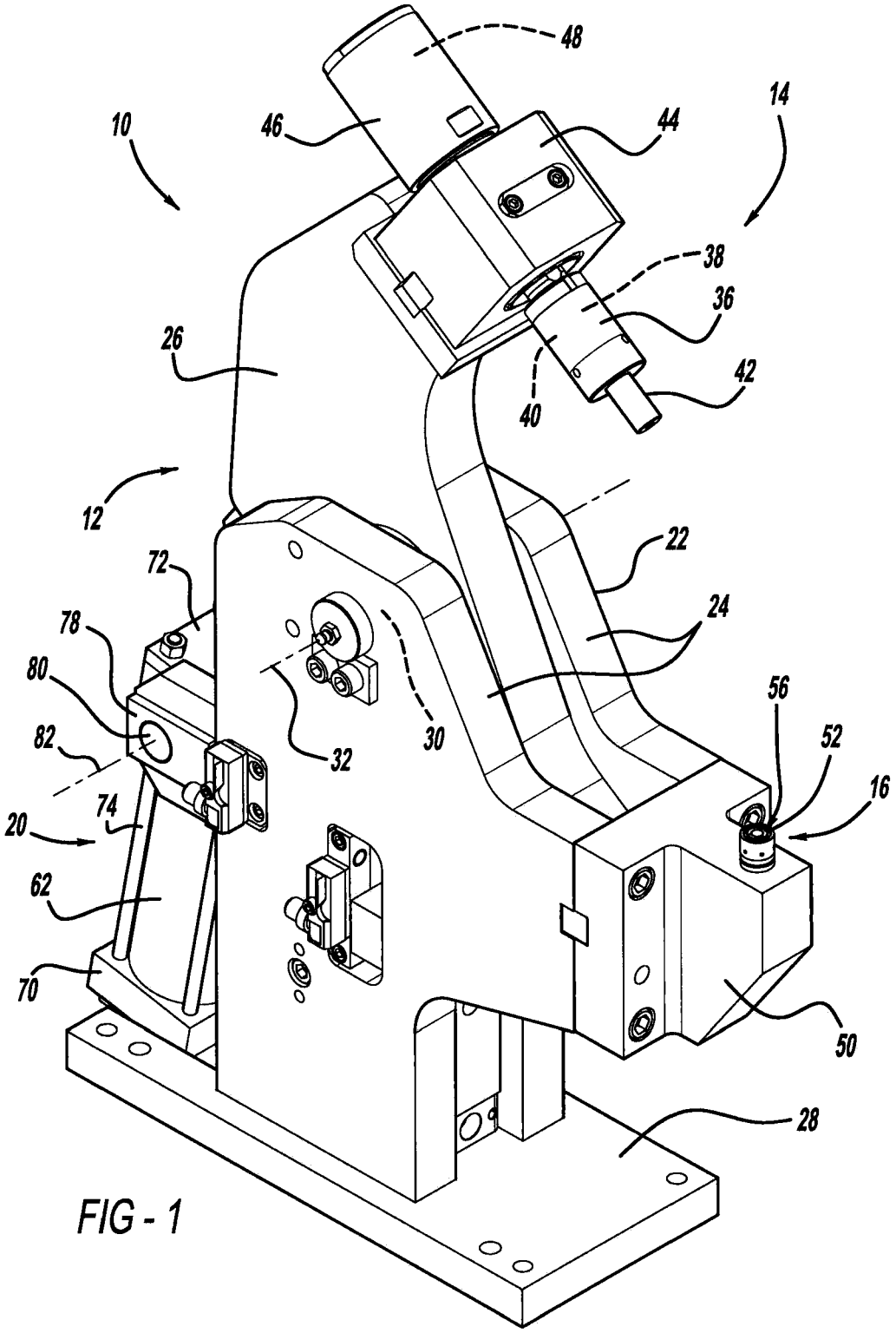
FIG. 1 is a perspective view of a clinch clamp constructed in accordance with the principles of the present invention and shown with the clinch clamp in an open position.
Figure 2:
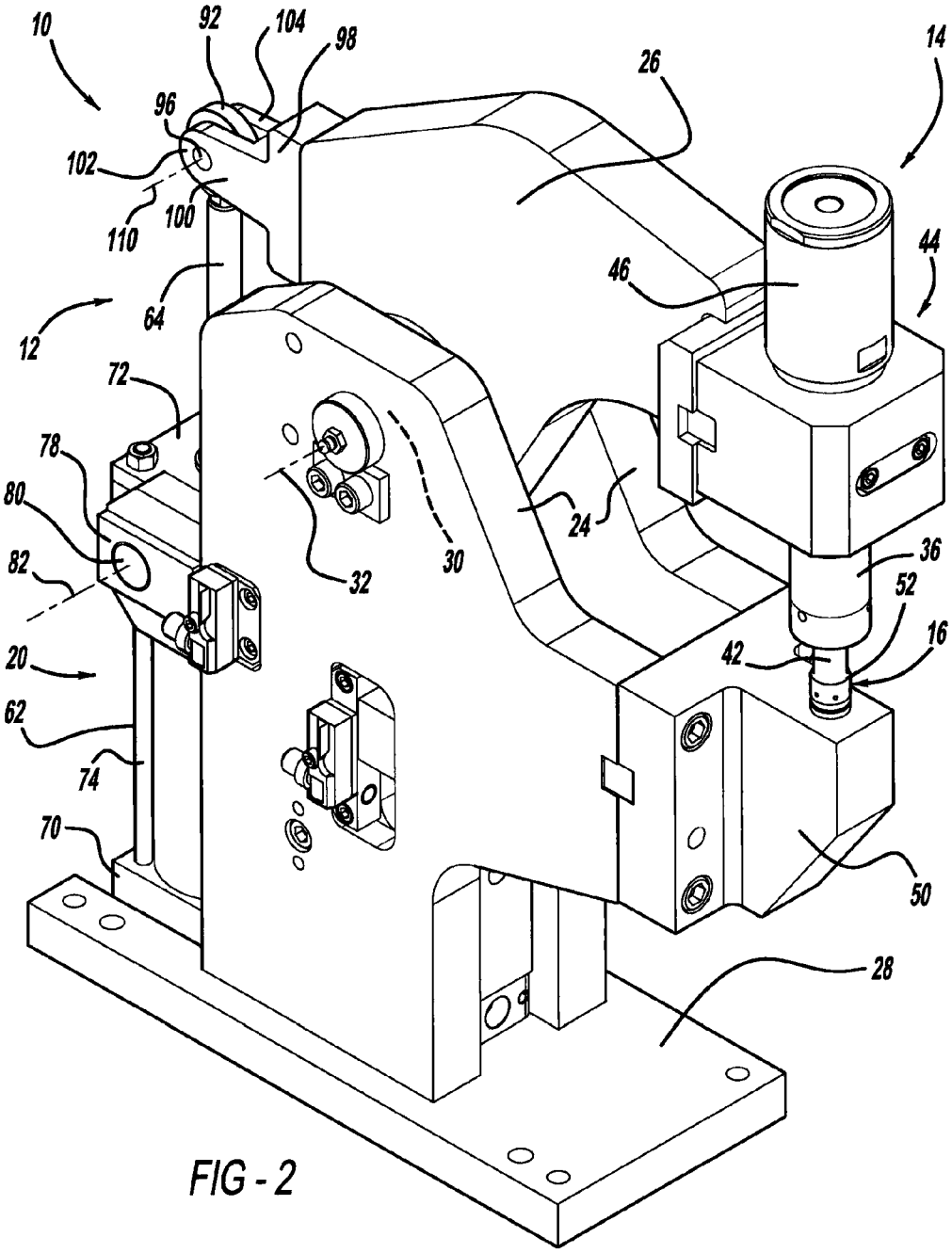
FIG. 2 is a perspective view of the clinch clamp of FIG. 1 and shown with the clinch clamp in the closed position.

With initial reference to FIGS. 1 and 2, an apparatus for clinching a workpiece constructed in accordance to the present invention is shown and generally identified at reference numeral 10. The apparatus 10 is preferably a clinch-type clamp. The apparatus 10 generally includes a body assembly 12, a punch assembly 14, a die assembly 16 and a first linear actuator 20. The body assembly 12 generally comprises a clamp body 22 having a pair of support arms 24 that support a swing arm 26. The body assembly 12 is fixedly mounted to a clamp base 28. The swing arm 26 is rotatably fixed to the clamp body 22 around a pivot pin 30 for rotation around an arm pivot axis 32. It can be appreciated that while the illustrated embodiment comprises support arms 24 that are bifurcated for supporting a single swing arm 26 therebetween, the clamp body 22 can alternatively comprise a single riser having a bifurcated swing arm pivotally mounted thereto.

The punch assembly 14 generally comprises a punch holder 36, a punch 38, a biasing member 40 (see also FIG. 8), and a stripper 42. The punch assembly 14 is mounted to the swing arm 26 by a cylinder mounting block 44. A punch cylinder 46 and actuator 48 are mounted against the cylinder mounting block 44. The actuator 48 is hydraulically actuated however other configurations, such as pneumatic and mechanical are contemplated. The biasing member 40 provides clamping force to the stripper 42.

Figure 6:
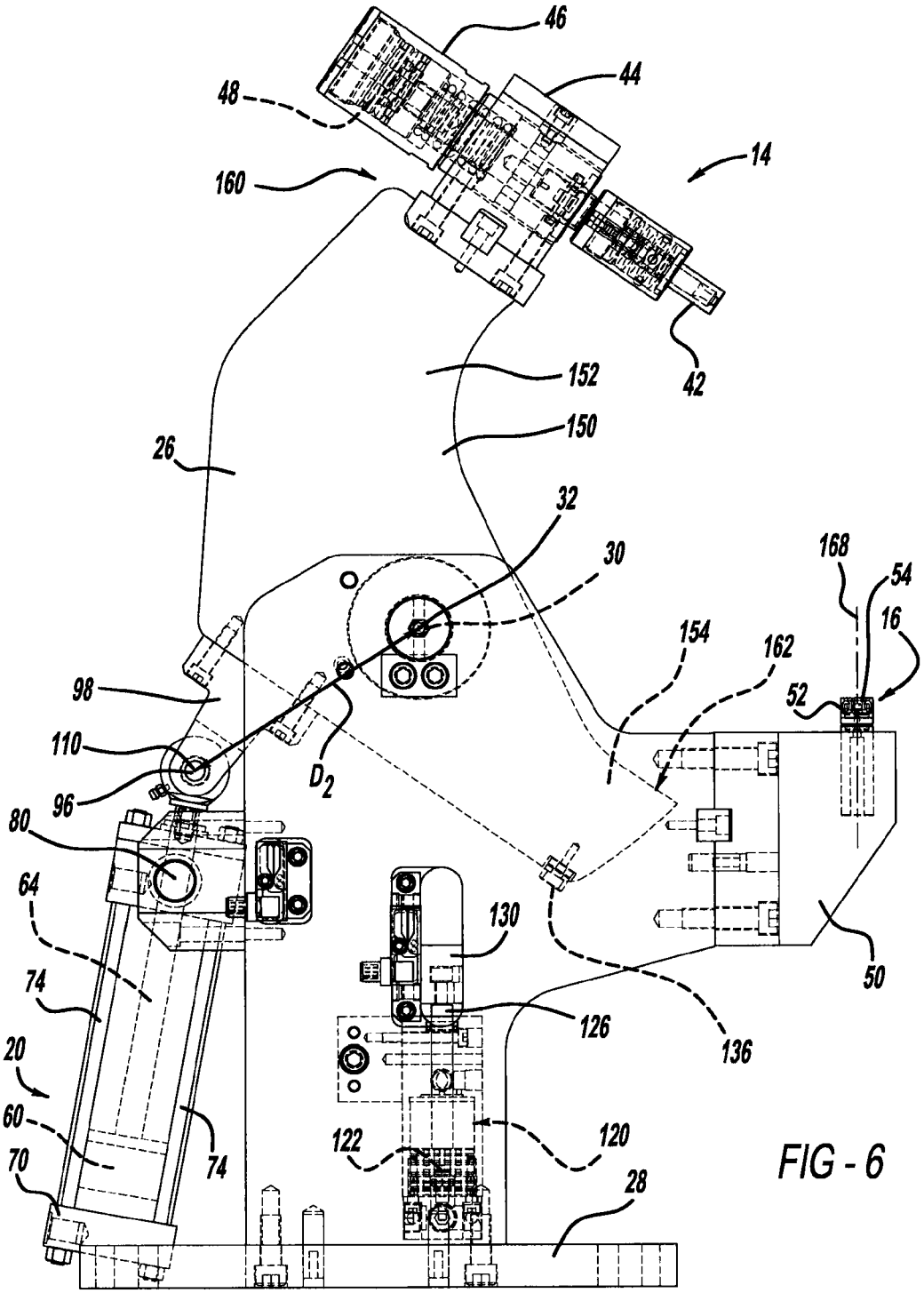
FIG. 6 is a side view of the clinch clamp of FIG. 1 and shown with a lockout key in a retracted position.

The die assembly 16 is fixedly mounted to the support arms 24 by a die support 50. The die assembly 16 generally includes a die body 52 and an anvil 54 (FIG. 6). The die assembly 16 further includes three movable die blades 56. While not specifically identified by reference numeral in the figures, the die assembly 16 further includes a guard, a canted coil spring, a dowel and a bolt. Further description of the die assembly 16 may be found in commonly owned U.S. Pat. Nos. 6,115,898; 6,092,270; and 5,581,860, which are expressly incorporated herein by reference.

With further reference now to FIGS. 3-7, the first linear actuator 20 will be further described. The first linear actuator 20 generally includes a piston 60 that translates through a cylinder 62. The first linear actuator 20 is a pneumatically actuated cylinder however other configurations, such as hydraulic and mechanical are contemplated. The piston 60 is fixedly connected to a piston rod 64. As will become appreciated from the following discussion, the piston rod 64 translates between a first position (or extended position), illustrated in FIG. 3, corresponding to the swing arm 26 being in a closed position to a second position (or retracted position), illustrated in FIG. 6, corresponding to the swing arm 26 being in an open position. The first linear actuator 20 further includes a lower end cap 70 and an upper end cap 72 connected at opposite ends of the cylinder 62 and further supported by four tie rods 74. The first linear actuator 20 is rotatably coupled to the clamp body 22 through a trunion mount 78. Explained further, the first linear actuator 20 is rotatably coupled through a cylinder pivot pin 80 extending through the trunion mount 78 for rotation around a cylinder pivot axis 82 (FIG. 1). A distal end 86 of the piston rod 64 includes a piston rod pivot joint 90. The piston rod pivot joint 90 generally includes a rod eye 92, a bushing 94, a piston rod pivot pin 96 and a piston rod mount 98. As viewed in FIG. 2, the piston rod mount 98 generally includes a clevis 100 having a first leg 102 and a second leg 104. The rod eye 92 is rotatably mounted around the piston rod pivot pin 96. The bushing 94 is interposed between the pivot pin 96 and the rod eye 92. The bushing 94 according to the present invention is constructed of bronze. The bronze bushing 94 provides favorable wear properties in the present application. The piston rod pivot pin 96 defines a pivot pin axis 110 through which the piston rod mount 98 and therefore the swing arm 26 rotates about.

With specific reference now to FIGS. 3 and 6-8, additional features of the apparatus 10 will be described. A second linear actuator 120 is mounted generally between the support arms 24 of the clamp body 22. The second linear actuator 120 is a pneumatically actuated cylinder however other configurations, such as hydraulic and mechanical are contemplated. The second linear actuator 120 generally includes a piston 122 that is configured for slidable translation within a cylinder 124. The piston 122 carries a rod 126 that has a lock-out key 130 disposed on a distal end 132 thereof. The second linear actuator 120 is configured to translate the lock-out key 130 between an extended position (FIGS. 3, 7 and 8) and a retracted position (FIG. 6). As will become appreciated from the following discussion, the lock-out key 130 is configured to move to the expanded position subsequent to the swing arm 26 being rotated to the closed position to engage the swing arm 26 and inhibit rotation of the swing arm 26 in a counter-clockwise direction around the swing arm pivot pin 30 during actuation of the punch 38. Subsequent to a punching event (e.g., clinching of a workpiece), the lock-out key 130 is retracted, such that the swing arm 26 is uninhibited from rotating in a counterclockwise direction around the pivot pin 30 as viewed in FIG. 3 to the open position as shown in FIG. 6.

Figure 8:
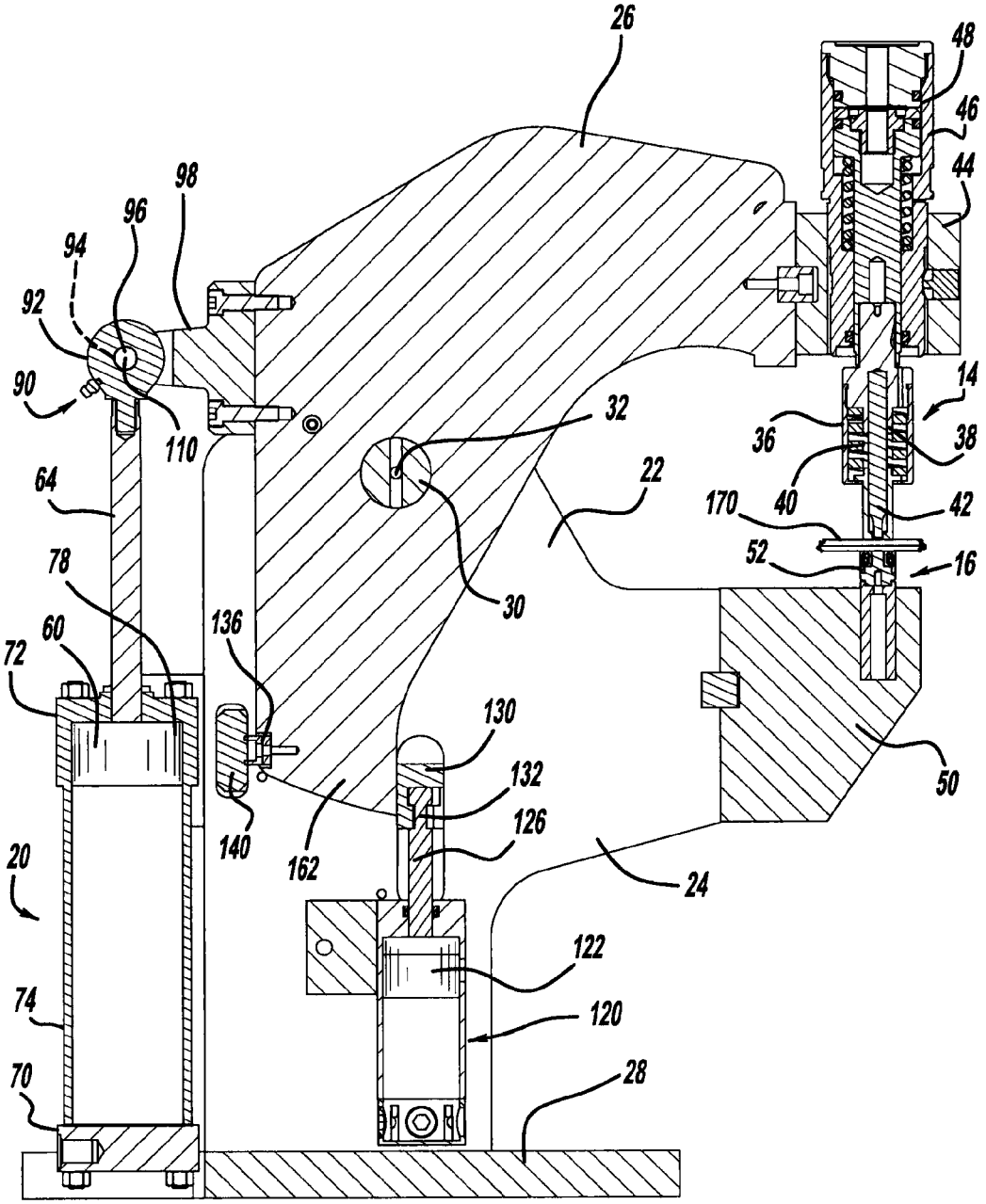
FIG. 8 is a cross-sectional view taken along lines 8-8 of FIG. 4.

With specific reference now to FIGS. 6 and 8, additional features of the apparatus 10 will be further described. An engagement member 136 is disposed on the swing arm 26. The engagement member 136 is configured to contact a hard stop 140 that is fixedly connected between the support arms 24 of the clamp body 22. Contact of the engagement member 136 onto the hard stop 140 facilitates the stopping of clockwise rotation of the swing arm 26 around the arm pivot axis 32 when rotating from the open position (FIG. 6) to the closed position (FIG. 8). As can be appreciated, the hard stop 140 can assist in dissipating the rotational stopping energy of the swing arm 26 that could otherwise be taken up by the piston rod pivot joint 90. The engagement member 136 can be formed of urethane or rubber. The hard stop 140 can be formed of metal, such as steel or other hard material.

Figure 3:
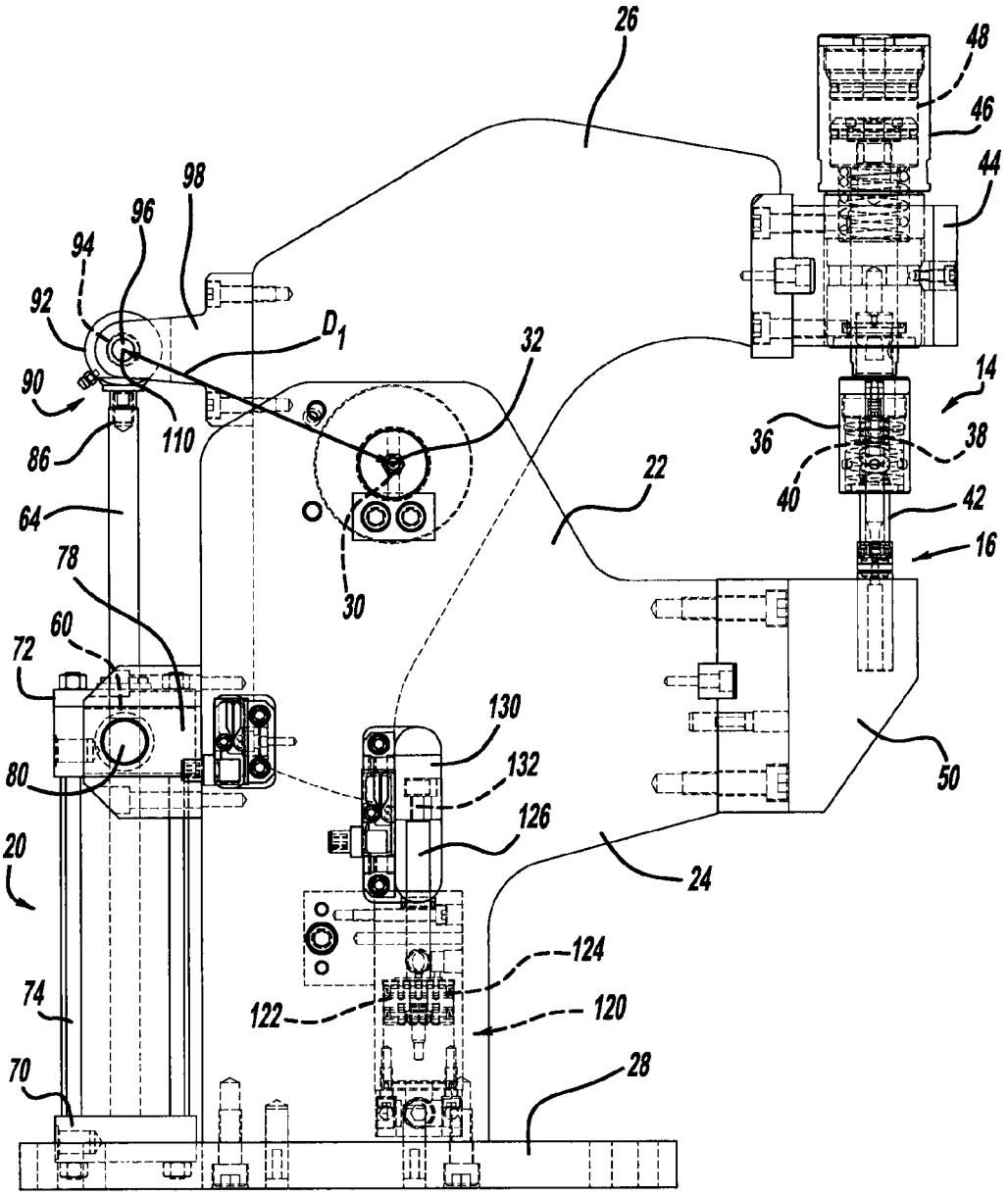
FIG. 3 is a side view of the clinch clamp of FIG. 2 shown in a work position.
Figure 4:
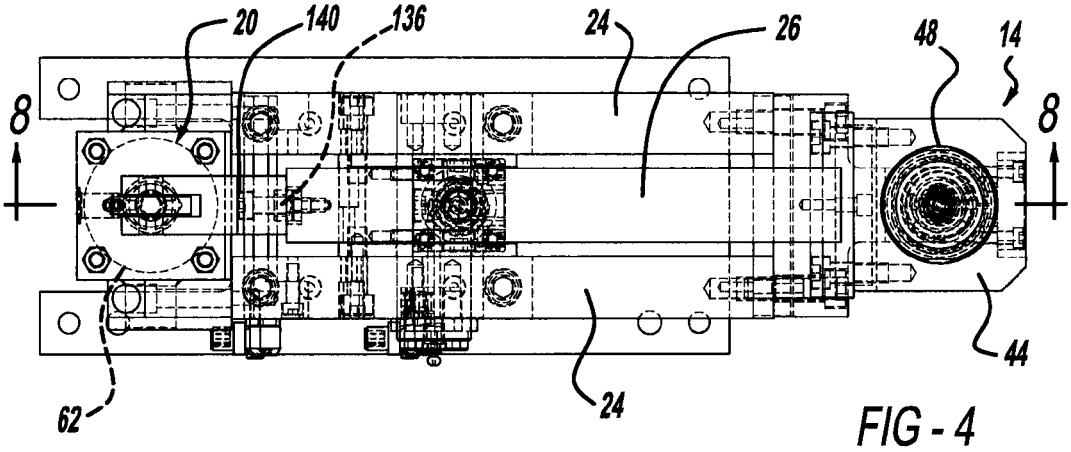
FIG. 4 is a top view of the clinch clamp of FIG. 2.
Figure 5:
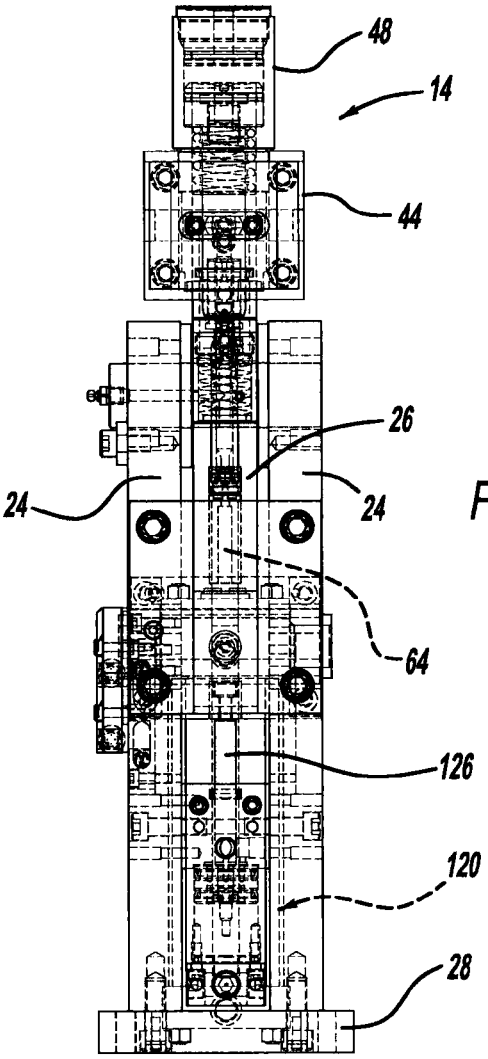
FIG. 5 is a front view of the clinch clamp of FIG. 2.

The apparatus 10 according to the present invention incorporates components that are arranged for rotational and translational movement that are without any joints that require a cam or track configuration. In this regard, a more robust, efficient and repeatable motion of the swing arm 26 between the open position (FIG. 1) and the closed position (FIG. 2) is provided. To further illustrate a geometrical relationship provided by the body assembly 12 and first linear actuator 20, specific reference now is made to FIGS. 3 and 6. A first distance $D_1$ is defined between the axis 32 of the swing arm pivot pin 30 and the axis 110 of the piston rod pivot pin 96. The distance $D_1$ is illustrated in FIG. 3 with the swing arm 26 in the closed position. A distance $D_2$ is defined between the axis 32 of the swing arm pivot pin 30 and the axis 110 of the piston rod pivot pin 96 with the swing arm 26 in the open position. The distances $D_1$ and $D_2$ are equivalent. Furthermore, the distance between the axis 32 of the swing arm pivot pin 30 and the axis 110 of the piston rod pivot pin 96 remains unchanged throughout the rotational motion of the swing arm 26 between the closed position (FIG. 3) and open position (FIG. 6).

With particular reference to FIG. 6, the swing arm 26 will be described in greater detail. The swing arm 26 generally comprises an arcuate or C-shaped body 150 including a first body portion 152 and a second body portion 154. The first body portion 152 extends between a first end 160 of the swing arm 26 and the axis 32 of the swing arm pivot pin 30. The second body portion 154 extends between a second end 162 of the swing arm 26 and the axis 32 of the swing arm pivot pin 30. According to an advantage of the present invention, the second body portion 154 of the swing arm 26 has a significant amount of mass opposite the first body portion 152 relative to the axis 32. In one example, the first body portion 152 can account for at least one-quarter of the mass of the swing arm 26. In this regard, the second body portion 154 can provide a counter balance to the mass associated with the first body portion 152 (and also the mass associated with the components of the punch assembly 14).

The apparatus 10 according to the present invention provides other useful advantages. Notably, with the swing arm 26 rotated to the open position as illustrated in FIG. 6, the immediate space above and adjacent to the die assembly 16 is unobstructed. Explained further, a longitudinal axis 168 taken through the die body 52 with the swing arm 26 rotated to the open position is non-intersecting relative to the punch assembly 14. In this regard, if desired, a user (a robot, etc.) is able to horizontally locate a workpiece (specifically identified at reference numeral 170 in FIG. 8) against the die body 52 with reduced effort as compared to introducing a workpiece that may require additional and/or more complicated movements, such as translating horizontally and/or rotating.

An exemplary method of using the apparatus 10 according to the present invention will now be described. At the outset, the body assembly 12 is rotated to the open position (FIGS. 1 and 6). A workpiece (identified at reference numeral 170 in FIG. 8) is then located generally against the die assembly 16. The first linear actuator 20 is then actuated, such that the piston rod 64 translates from the retracted position illustrated in FIG. 6 to the expanded position illustrated in FIG. 3. During the actuation of the piston rod 64, the cylinder 62 of the first linear actuator 20 is caused to rotate around the cylinder pivot axis 82 in a direction counterclockwise as viewed in the figures relative to the cylinder pivot pin 80 of the trunion mount 78. Concurrently, the piston rod mount 98 is caused to rotate clockwise around the axis 110 of the piston rod pivot pin 96. During rotational movement of the cylinder 62 relative to the trunion mount 78, the lower end cap 70 simply rotates uninhibited in a direction away from the clamp body 22. Rotation of the piston rod mount 98 around the axis 110 causes the swing arm 26 to rotate in a direction clockwise (as view in FIG. 6) around the swing arm pivot pin 30 until the engagement member 136 disposed on the second end 162 of the swing arm 26 engages the hard stop 140 disposed on the clamp body 22 (FIG. 8).

Figure 7:
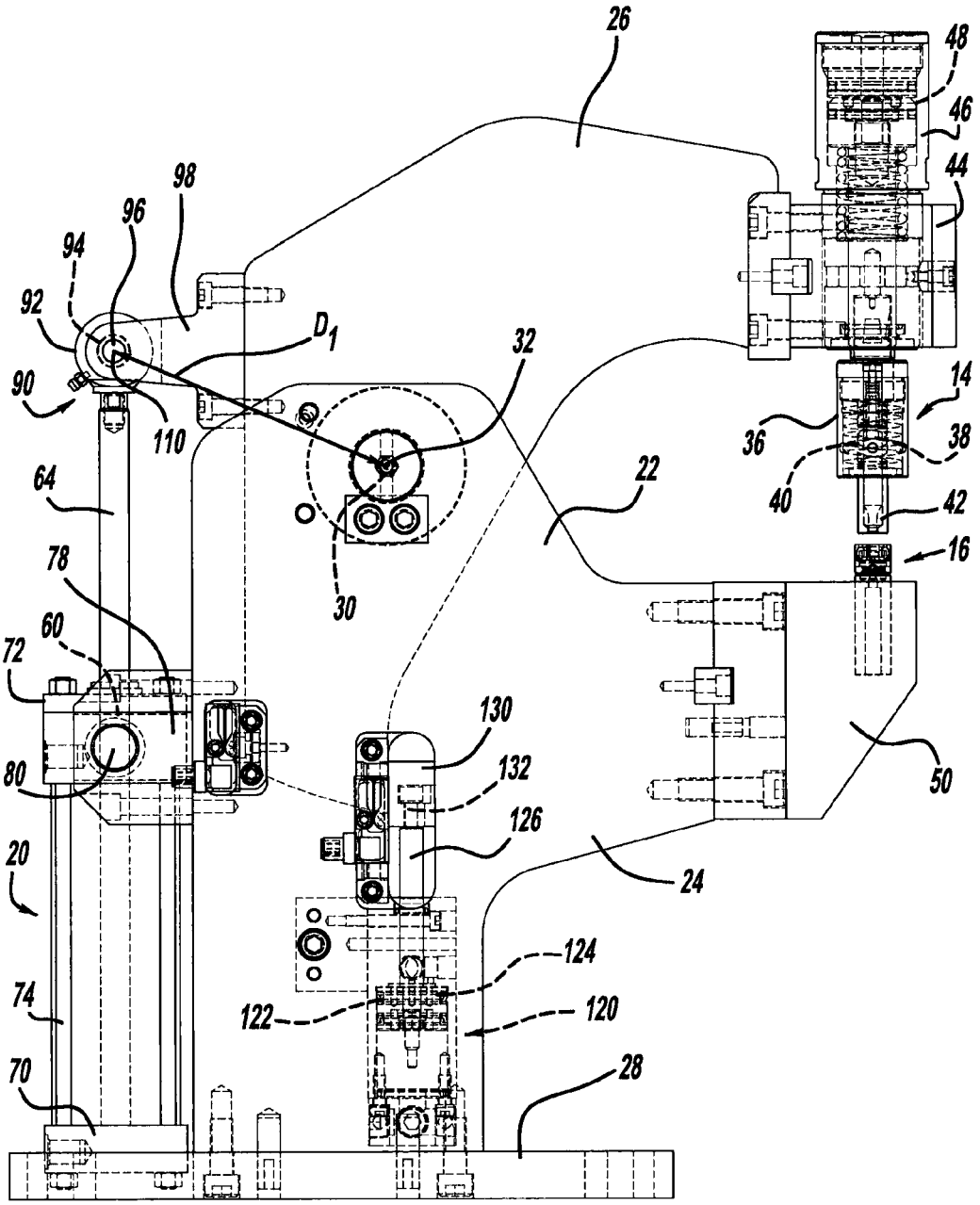
FIG. 7 is a side view of the clinch clamp of FIG. 3 and shown in a closed position with the lockout key in an extended position.

At this point, the swing arm 26 is in the closed position as shown in FIGS. 3, 7 and 8. Next, the second linear actuator 120 is actuated causing the rod 126 and lock-out key 130 to move from the position shown in FIG. 6 to the position shown in FIG. 8. The lock-out key 130 is now in position to resist any counterclockwise rotation of the swing arm 26 about the pivot axis 32 that is caused from firing of the punch 38. With the lock-out key 130 expanded to the position shown in FIG. 8, the punch 38 can then be actuated creating a clinch joint on the workpiece 170. The punch 38 is linearly actuated in a direction along the longitudinal axis 168 (FIG. 6). Again, a backlash force that may tend to influence the swing arm 26 to rotate in a counterclockwise direction around the pivot axis 32 resulting from engagement of the punch 38 onto the workpiece 170 can be blocked by the lock-out key 130. Once the clinch joint has been made, the punch 38 is then retracted by the cylinder 46. The second linear actuator 120 is then retracted, such that the rod 126 translates back into the cylinder 124 to a position where the lock-out key 130 clears the second end 162 of the swing arm 26 (FIG. 6).

The first linear actuator 20 is then actuated, such that the piston rod 64 retracts into the cylinder 62 causing the piston rod mount 98 to rotate in a counterclockwise direction around the axis 110 of the piston rod pivot pin 96. Concurrently, the cylinder 62 rotates in a clockwise direction around the cylinder pivot axis 82 (FIG. 1). As can be appreciated, the swing arm 26 is therefore caused to rotate in a counterclockwise direction around the axis 32 of the swing arm pivot pin 30 until reaching the open position shown in FIG. 6. The method then repeats for successive clinching operations.

With reference now to FIGS. 9-13, an apparatus for clinching a workpiece constructed in accordance to additional features of the present invention is shown and generally identified at reference numeral 210. The apparatus 210 is preferably a clinch-type clamp. The apparatus 210 generally includes a body assembly 212, a punch assembly 214, a die assembly 216 and a first linear actuator 220. The body assembly 212 generally comprises a clamp body 222 having a pair of support arms 224 (FIG. 10) that support a swing arm 226. The body assembly 212 is fixedly mounted to a clamp base 228. The swing arm 226 is rotatably fixed to the clamp body 222 around a pivot pin 230 for rotation about an arm pivot axis 232. It will be appreciated that while the illustrated embodiment comprises support arms 224 that are bifurcated for supporting a single swing arm 226 therebetween, the clamp body 222 can alternatively comprise a single riser having a bifurcated swing arm pivotally mounted thereto.

The punch assembly 214 generally comprises a punch holder 236, a punch 238, a biasing member 240 and a stripper 242. The punch assembly 214 is mounted to the swing arm 226 by a cylinder mounting block 244. A punch cylinder 246 and an actuator 248 are mounted against the cylinder mounting block 244. The actuator 248 is an air/oil intensifying cylinder however, other configurations, such as pneumatic and mechanical are contemplated. The biasing member 240 provides a clamping force to the stripper 242.

The die assembly 216 is fixedly mounted to the support arms 224 by a die support 250. The die assembly 216 can have any configuration such as one that includes three movable die blades as discussed above with respect to the die assembly 16. Other configurations are contemplated.

Figure 9:
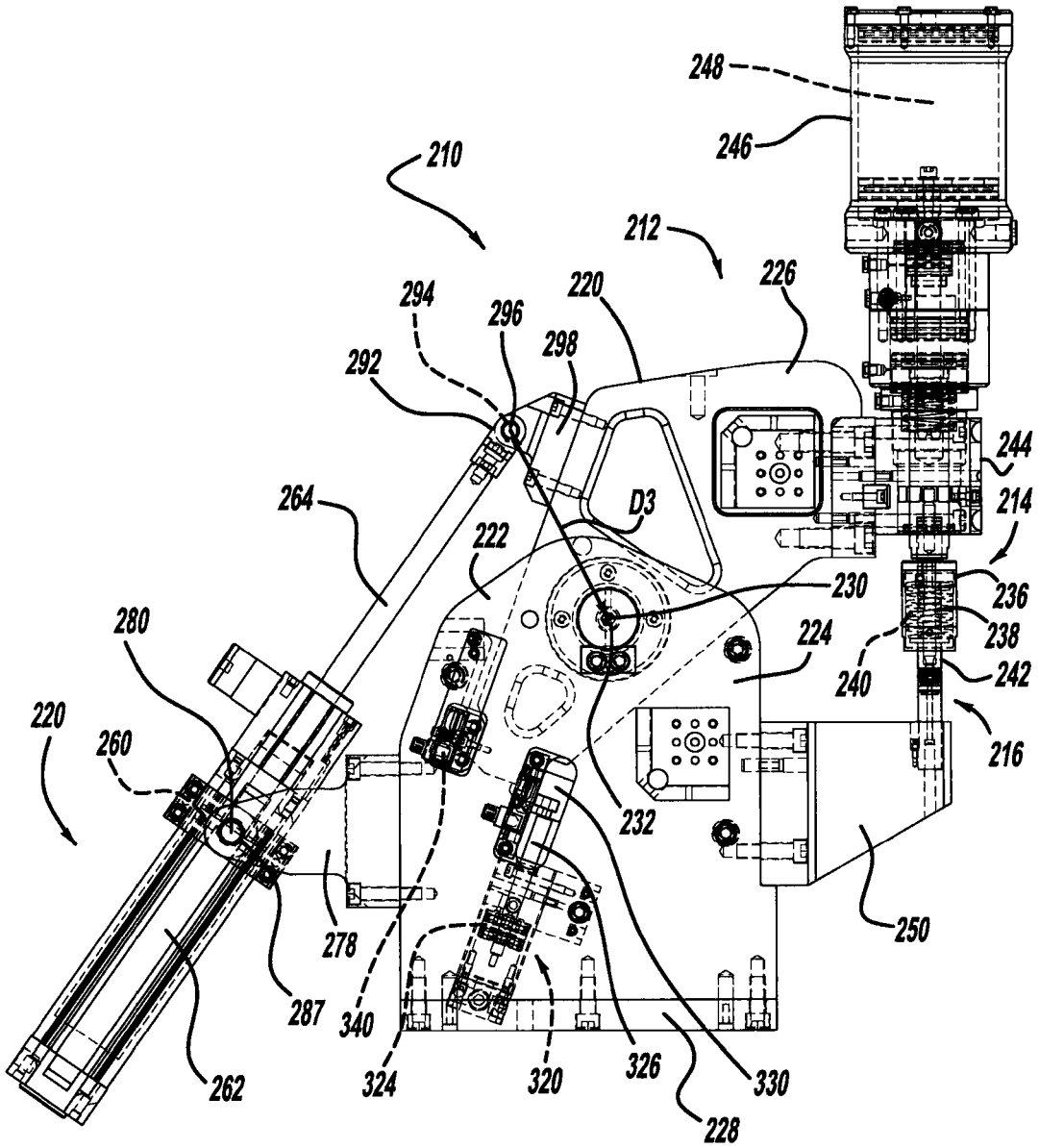
FIG. 9 is a side view of a clinch clamp constructed in accordance with additional features of the present invention and shown with the clinch clamp in a closed position and shown with the punch in an actuated position.
Figure 10:
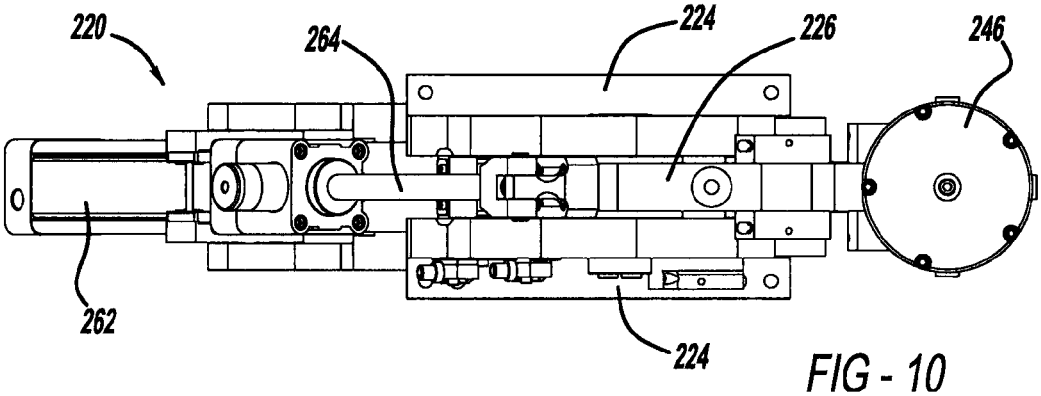
FIG. 10 is a top view of the clinch clamp of FIG. 9.
Figure 11:
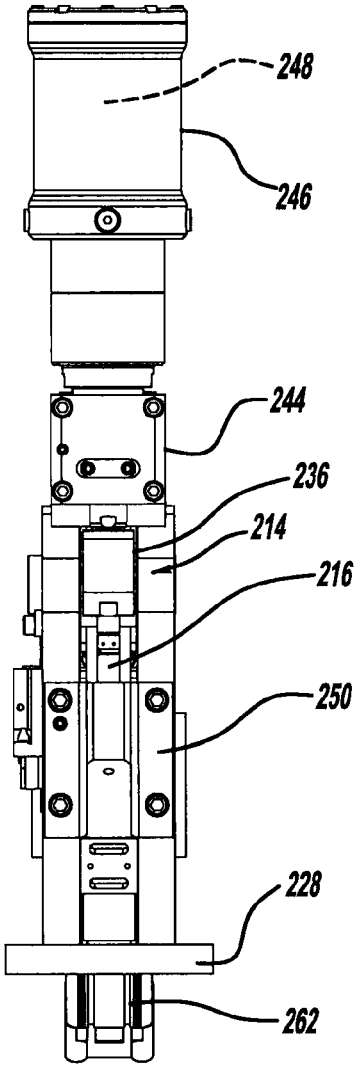
FIG. 11 is a front view of the clinch clamp of FIG. 9.
Figure 12:
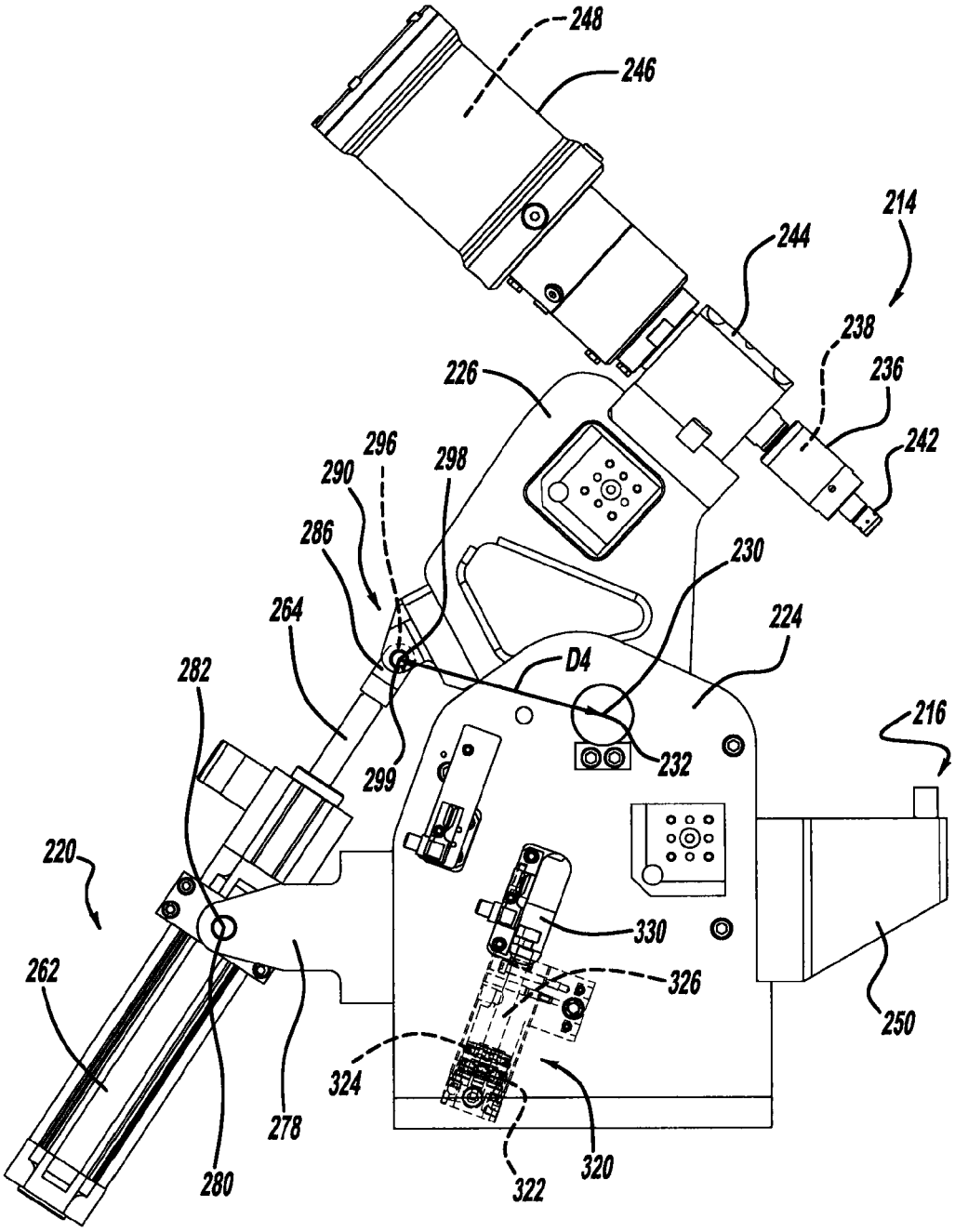
FIG. 12 is a side view of the clinch clamp of FIG. 9 and shown with the clinch clamp in the open position and with a lockout key in a retracted position.
Figure 13:
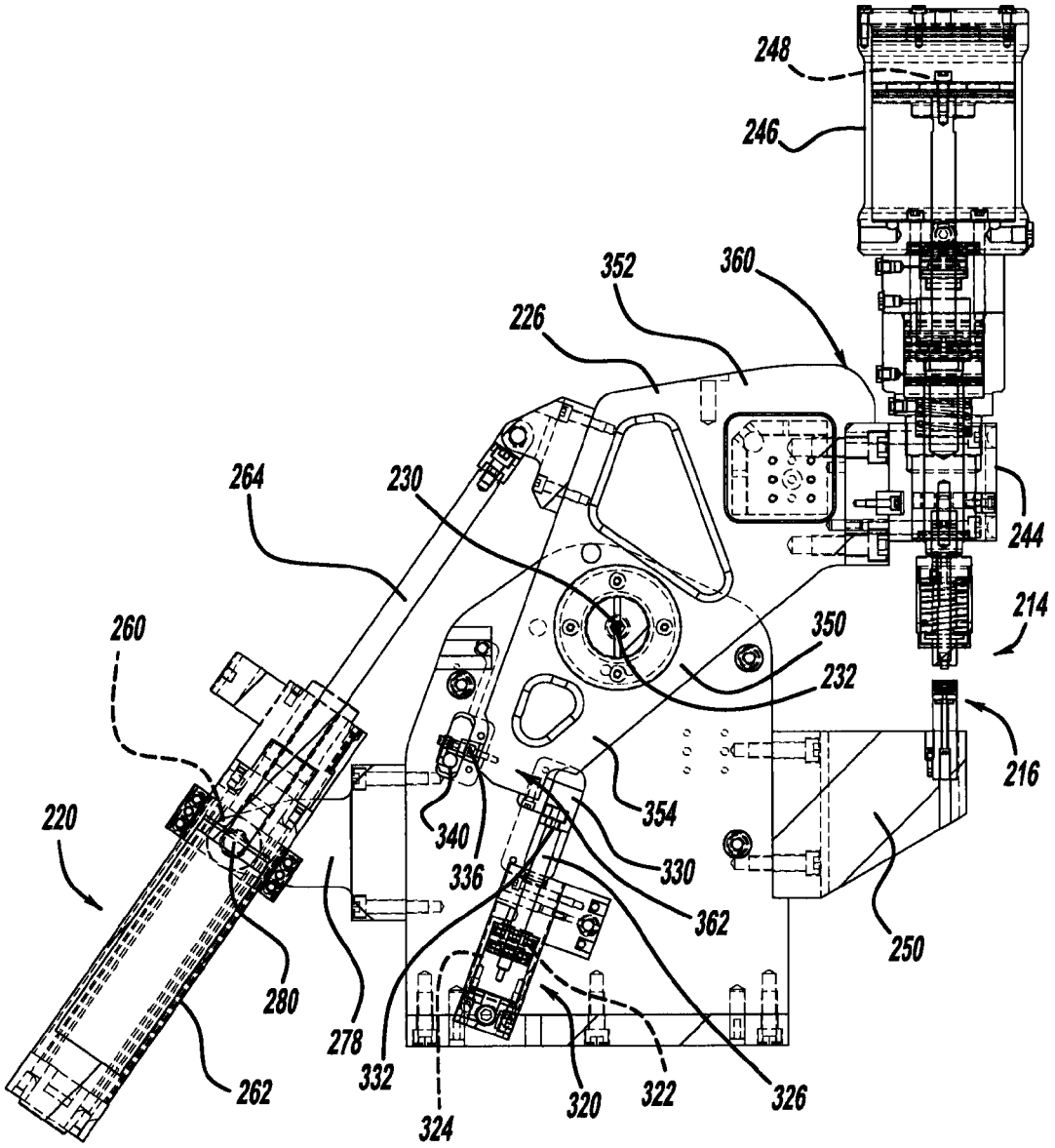
FIG. 13 is a cross-sectional view of the clinch clamp of FIG. 9 and shown with the punch in a retracted position.
Figure 14:
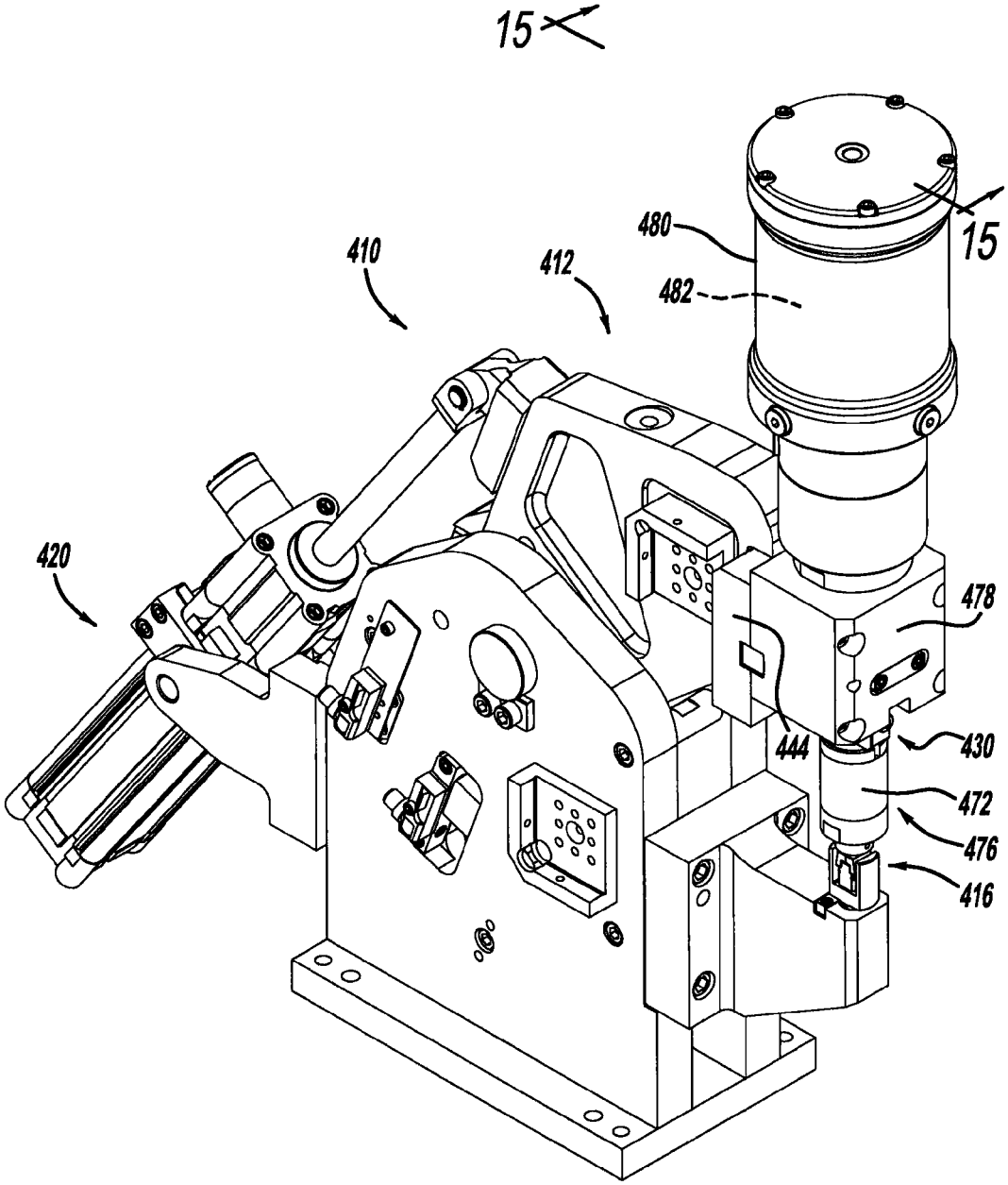
FIG. 14 is a perspective view of a clinch clamp constructed in accordance with additional principles of the present invention and incorporating an anti-rotation feature, the clinch clamp shown in a closed position.

With reference now to FIGS. 9, 12, and 13, the first linear actuator 220 will be further described. The first linear actuator 220 generally includes a piston 260 that translates through a cylinder 262. The first linear actuator 220 is a pneumatically actuated cylinder however, other configurations, such as hydraulic and mechanical are contemplated. The piston 260 is fixedly connected to a piston rod 264. As will become appreciated from the following discussion, the piston rod 264 translates between a first position (or extended position), illustrated in FIGS. 9 and 13, corresponding to the swing arm 226 being in a closed position to a second position (or retracted position), illustrated in FIG. 12, corresponding to the swing arm 226 being in an open position. The first linear actuator 220 is rotatably coupled to the clamp body 222 through a trunion mount 278. The first linear actuator 220 is rotatably coupled through a cylinder pivot pin 280 extending through the trunion mount 278 for rotation about a cylinder pivot axis 282 (FIG. 12). A distal end 286 of the piston rod 264 includes a piston rod pivot joint 290. The piston rod pivot joint 290 generally includes a rod eye 292 (FIG. 9), a bushing 294, a piston rod pivot pin 296, and a piston rod mount 298. The piston rod pivot joint 290 may be configured similarly to the piston rod pivot joint 90 described above with respect to FIGS. 3-7. The piston rod pivot pin 296 defines a pivot pin axis 299 through which the piston rod mount 298 and, therefore the swing arm 226 rotates about.

Figure 15:
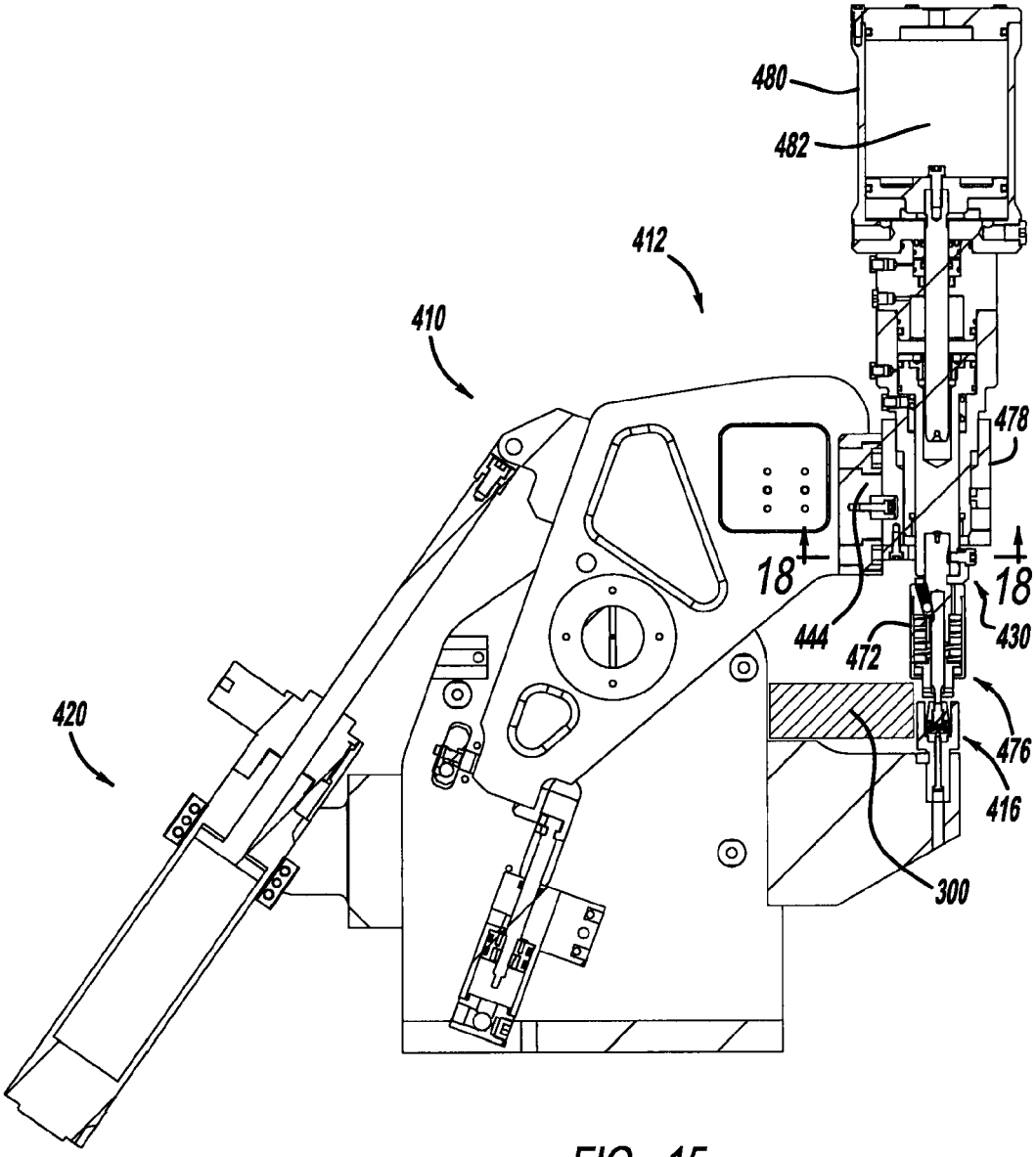
FIG. 15 is a cross-sectional view taken along lines 15-15 of FIG. 14.
Figure 16:
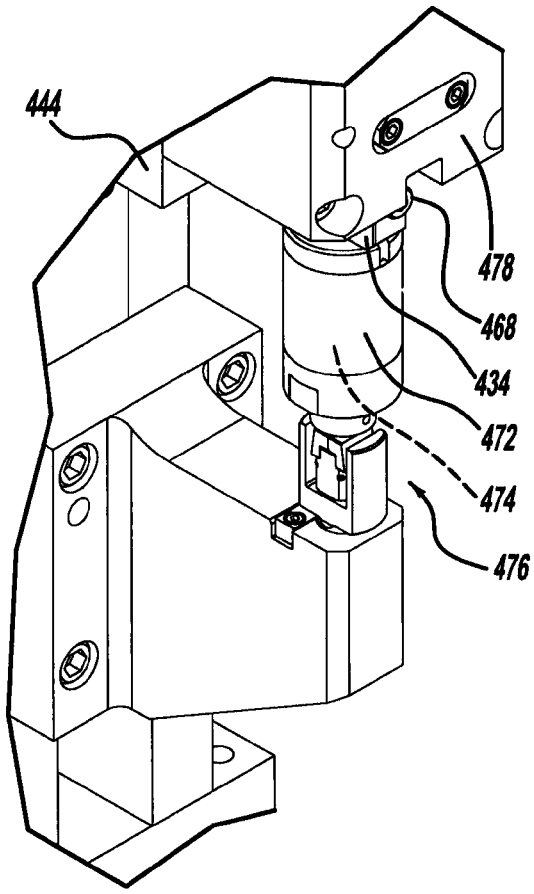
FIG. 16 is a front perspective view of the anti-rotation feature of the clinch clamp of FIG. 14.
Figure 17:
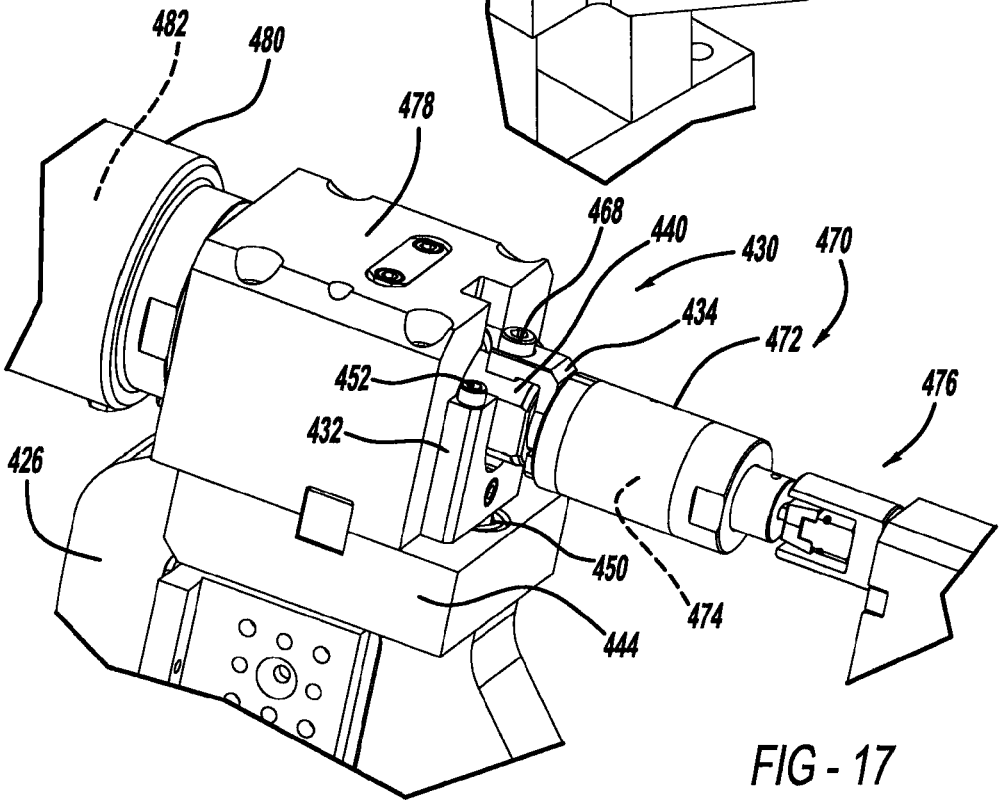
FIG. 17 is a bottom side perspective view of the anti-rotation feature of the clinch clamp of FIG. 14.
Figure 18:
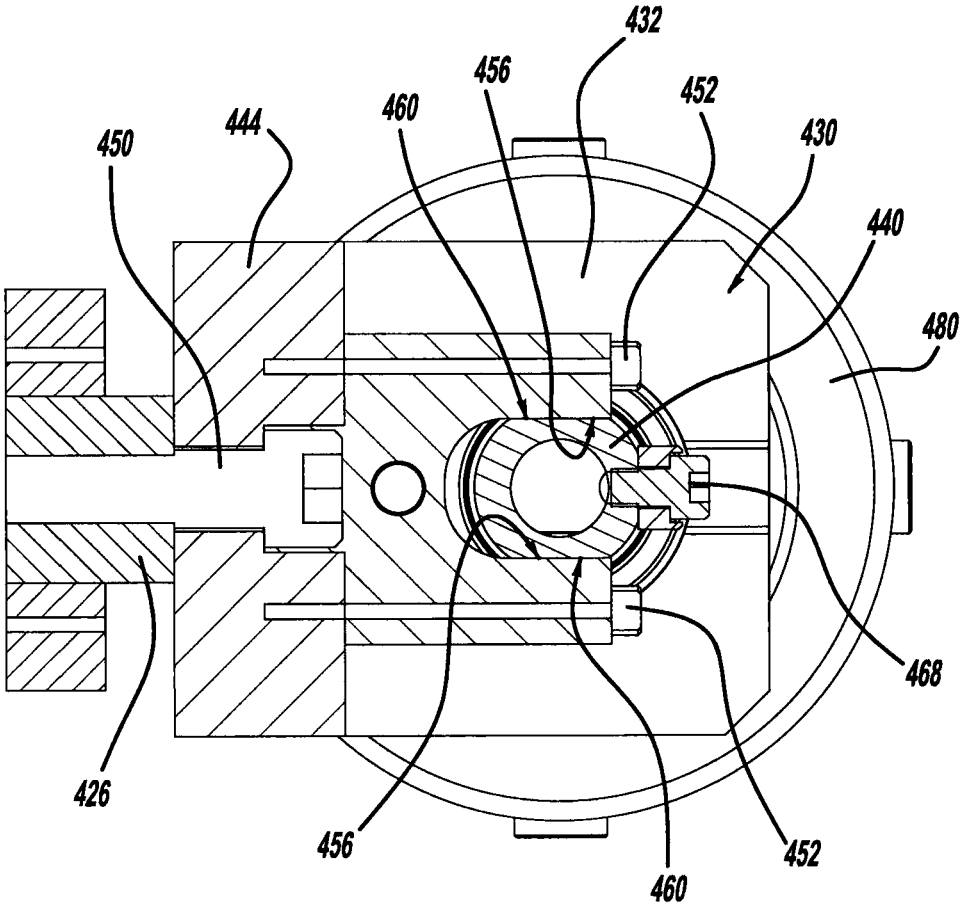
FIG. 18 is a cross-sectional view taken along lines 18-18 of FIG. 15.

The linear actuator 220 remains at a non-orthogonal angle relative to the clamp base 228 in both the closed position (FIG. 9) and the open position (FIG. 12). Such a relationship allows an increase in throat depth, identified at area 300 (FIG. 15).

A second linear actuator 320 is mounted generally between the support arms 224 of the clamp body 222. The second linear actuator 320 is a pneumatically actuated cylinder however, other configurations, such as hydraulic and mechanical are contemplated. The second linear actuator 320 generally includes a piston 322 that is configured for slidable translation within a cylinder 324. The piston 322 carries a rod 326 that has a lock-out key 330 disposed on a distal end 332 thereof. The second linear actuator 320 is configured to translate the lock-out key 330 between an extended position (FIGS. 9 and 13) and a retracted position (FIG. 12). The lock-out key 330 is configured to move to the expanded position subsequent to the swing arm 226 being rotated to the closed position to engage the swing arm 226 and inhibit rotation of the swing arm 226 in a counterclockwise direction around the swing arm pivot pin 230 during actuation of the punch 238. The lock-out key 330 can operate similar to the lock-out key 130 described above. In this regard, subsequent to a punching event, the lock-out key 330 is retracted, such that the swing arm 226 is uninhibited from rotating in a counterclockwise direction around the pivot pin 230 as viewed in FIG. 9 to the open position as shown in FIG. 12. The second linear actuator 320 is also arranged at a non-orthogonal angle relative the clamp base 228 to align with the swing arm 226.

An engagement member 336 (FIG. 13) is disposed on the swing arm 226. The engagement member 336 is configured to contact a hard stop 340 that is fixedly connected between the support arms 224 of the clamp body 222. The configuration of the engagement member 336 and the hard stop 340 is similar to that described above with respect to the engagement member 136 and 140. In this regard, the engagement member 336 is configured to engage the hard stop 340 to facilitate the stopping of clockwise rotation of the swing arm 226 around the arm pivot axis 232 when rotating from the open position (FIG. 12) to the closed position (FIG. 13). The hard stop 340 can assist in dissipating the rotational stopping energy of the swing arm 226 that could otherwise be taken up by the piston rod pivot joint 290.

As with the apparatus 10 described above, the apparatus 210 according to the present invention incorporates components that are arranged for rotational and translational movement that are without any joints that require a cam or track configuration. In this regard, a more robust, efficient, and repeatable motion of the swing arm 226 between the open position (FIG. 12) and the closed position (FIGS. 9 and 13) is provided. To further illustrate a geometrical relationship provided by the body assembly 212 and the first linear actuator 220, specific reference now is made to the FIGS. 9 and 12. A first distance $D_3$ is defined between the axis 232 of the swing arm pivot pin 230 and the axis 299 of the piston rod pivot pin 296. The distance $D_3$ is illustrated in FIG. 9 with the swing arm 226 in the closed position. A distance $D_4$ is defined between the axis 232 of the swing arm pivot pin 230 and the axis 299 of the piston rod pivot pin 296 with the swing arm 226 in the open position. The distances $D_3$ and $D_4$ are equivalent. Furthermore, the distance between the axis 232 of the swing arm pivot pin 230 and the axis 299 of the piston rod pivot pin 296 remains unchanged throughout the rotational motion of the swing arm 226 between the closed position (FIGS. 9 and 13) and the open position (FIG. 12).

With particular reference now to FIG. 13, the swing arm 226 will be described in greater detail. The swing arm 226 generally comprises an arcuate or C-shaped body 350 including a first body portion 352 and a second body portion 354. The first body portion 352 extends between a first end 360 of the swing arm 226 and the axis 232 of the swing arm pivot pin 230. The second body portion 354 extends between a second end 362 of the swing arm 226 and the axis 232 of the swing arm pivot pin 230. Similar to the swing arm configuration described above with respect to the swing arm 26, the swing arm 226 incorporates a significant amount of mass on the second body portion 354 opposite the first body portion 352 relative to the axis 232. In one example, the first body portion 352 can account for at least one-quarter of the mass of the swing arm 226. In this regard, the second body portion 354 can provide a counter balance to the mass associated with the first body portion 352 (and also the mass associated with the components of the punch assembly 214). In addition, when the swing arm 226 is rotated to the open position as illustrated in FIG. 12, the immediate space above and adjacent to the die assembly 216 is unobstructed.

An exemplary method of using the apparatus 210 according to the present invention will now be described. At the outset, the body assembly 212 is rotated to the open position (FIG. 12). A workpiece (not specifically shown) may be generally located against the die assembly 216. The first linear actuator 220 is then actuated, such that the piston rod 264 translates from the retracted position illustrated in FIG. 12 to the expanded position illustrated in FIG. 13. During the actuation of the piston rod 264, the cylinder 262 of the first linear actuator 220 is caused to rotate around the cylinder pivot axis 282 (FIG. 12) in a direction counterclockwise as viewed in the Figures relative to the cylinder pivot pin 280 of the trunion mount 278. Concurrently, the piston rod mount 298 is caused to rotate clockwise around the axis 299 of the piston rod pivot pin 296. During rotation of the piston rod mount 298 around the axis 299 causes the swing arm 226 to rotate in a direction clockwise (as viewed in FIG. 12) around the swing arm pivot pin 230 until the engagement member 336 (FIG. 13) disposed on the second end 362 of the swing arm 226 engages the hard stop 340 disposed on the clamp body 222. At this point, the swing arm 226 is in the closed position as illustrated in FIG. 9. Next, the second linear actuator 320 is actuated causing the rod 326 and the lock-out key 330 to move from the position shown in FIG. 12 (retracted position) to the position shown in FIG. 13 (actuated position). The lock-out key 330 is now in position to resist any counterclockwise rotation of the swing arm 226 about the pivot axis 232 that is caused from firing of the punch 238.

With the lock-out key 330 expanded to the position shown in FIG. 13, the punch 238 can then be actuated from the position shown in FIG. 13 to the position shown in FIG. 9. Again, a backlash force that may tend to influence the swing arm 226 to rotate in a counterclockwise direction around the pivot axis 232 resulting from the engagement of the punch 238 onto a workpiece can be blocked by the lock-out key 330. Once the clinch joint has been made, the punch 238 is then retracted by the cylinder 246. The second linear actuator 320 is then retracted, such that the rod 326 translates back into the cylinder 324 to a position where the lock-out key 330 clears the second end 362 of the swing arm 226 (FIG. 12). The first linear actuator 220 is then actuated, such that the piston rod 264 retracts into the cylinder 262 causing the piston rod mount 298 to rotate in a counterclockwise direction around the axis 299 of the piston rod pivot pin 296. Concurrently, the cylinder 262 rotates in a clockwise direction around the cylinder pivot axis 282 (FIG. 12). As can be appreciated, the swing arm 226 is therefore caused to rotate in a counterclockwise direction around the axis 232 of the swing arm pivot pin 230 until reaching the open position shown in FIG. 12. The method then repeats for successive clinching operations.

With reference now to FIGS. 14-18, an apparatus for clinching a workpiece constructed in accordance to additional features of the present invention is shown and generally identified at reference numeral 410. The apparatus 410 is preferably a clinch-type clamp. The apparatus 410 generally includes a body assembly 412, a die assembly 416, and a first linear actuator 420. The apparatus 410 is constructed substantially similar to the apparatus 210 described above and shown in FIGS. 9-13, however the apparatus 410 incorporates an anti-rotation feature 430. The following discussion will be directed toward features associated with the anti-rotation feature 430. A description of the remainder of the apparatus 410 may be found above with the description of the apparatus 210 and will not be repeated here. The anti-rotation feature 430 generally includes an anti-rotation block 432, an anti-rotation key 434, and a punch 440. The anti-rotation block 432 is rigidly secured to a support block 444 that is coupled to a swing arm 426 with a fastener 450. The anti-rotation block 432 is coupled to the support block 444 by way of fasteners 452. The anti-rotation block 432 incorporates opposing flats 456 (FIG. 18) that are configured to slidably engage complementary flats 460 formed on the punch 440.

The anti-rotation key 434 is coupled to the punch 440 by way of a fastener 468. The anti-rotation feature 430 is configured to cooperate with a punch assembly 470 that generally comprises a punch holder 472, the punch 440, a biasing member 474 and a stripper 476. The punch assembly 470 is mounted to the swing arm 426 by a cylinder mounting block 478 and the support block 444. A punch cylinder 480 and an actuator 482 are mounted against the cylinder mounting block 478. The respective flats 456 of the anti-rotation block 432 and flats 460 of the punch 440 maintain a fixed rotational orientation of the punch 440 and punch assembly 470 as a whole. It will be appreciated that the anti-rotation feature 430 may also be incorporated on the apparatus 10 described above with respect to FIGS. 1-8.

Figure 19:
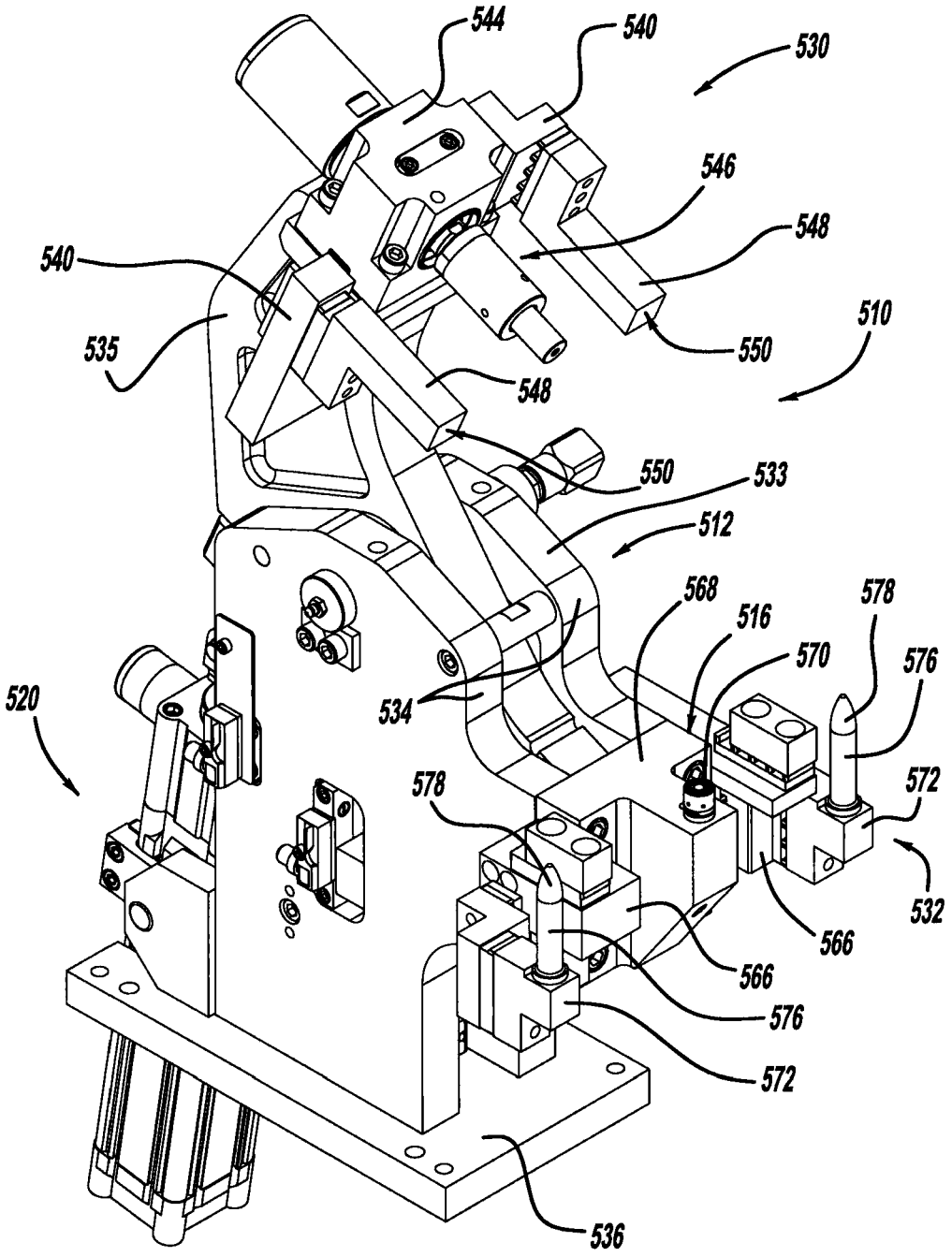
FIG. 19 is a perspective view of a clinch clamp constructed with additional principles of the present invention and shown in an open position.
Figure 20:
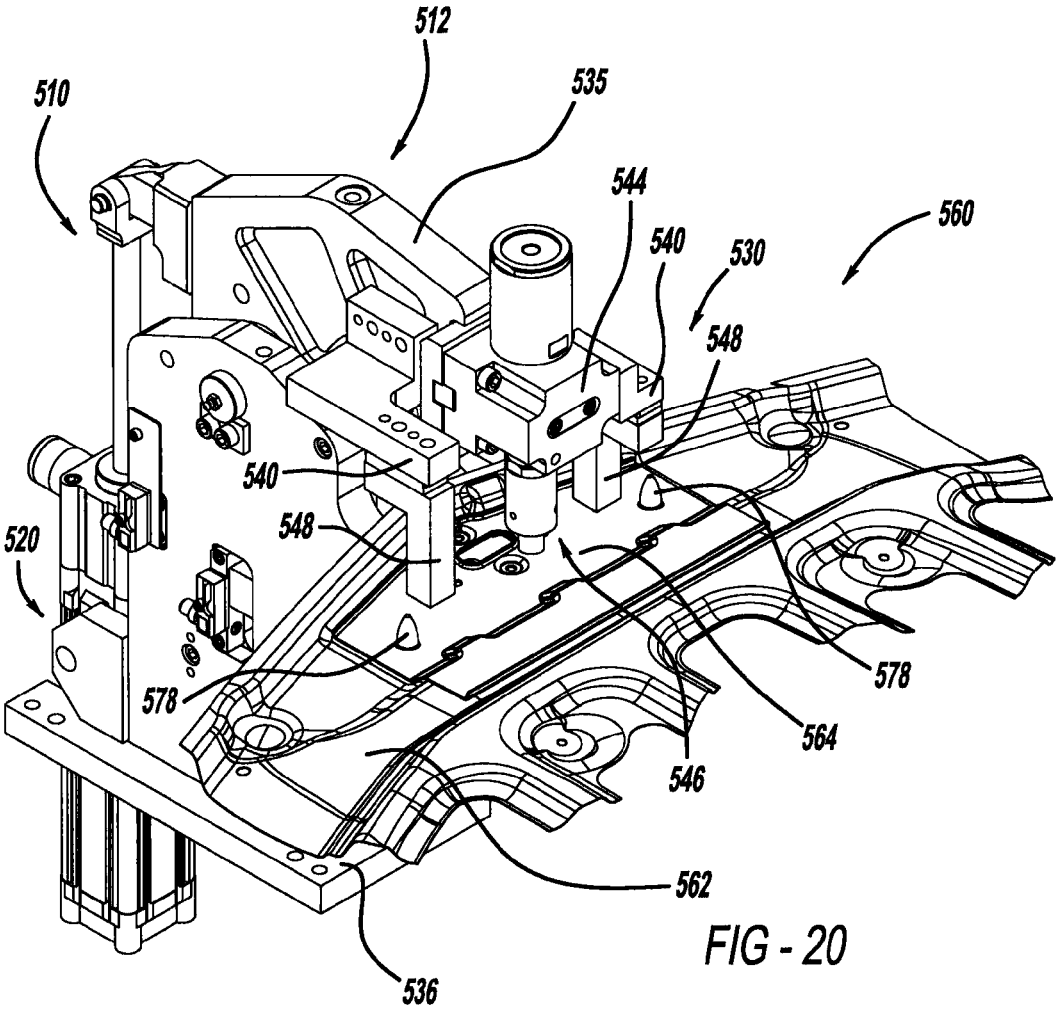
FIG. 20 is a perspective view of the clinch clamp of FIG. 19 and shown in a closed, working position.

With reference now to FIGS. 19 and 20, an apparatus for clinching a workpiece constructed in accordance to additional features of the present invention is shown and generally identified at reference numeral 510. The apparatus 510 is preferably a clinch-type clamp. The apparatus 510 generally includes a body assembly 512, a die assembly 516, and a first linear actuator 520. The apparatus 510 is constructed substantially similar to the apparatuses 10 and 210 described above, however the apparatus 510 incorporates a locater arm assembly 530 and a locater pin mount assembly 532. The body assembly 512 comprises a clamp body 533 having a pair of support arms 534 that support a swing arm 535. The first linear actuator 520 is configured to be arranged similar to the actuator 20 in that the first linear actuator 520 attains a substantially vertical orientation relative to a clamp base 536 in the closed position (FIG. 20). The following discussion will be directed toward features associated with the locater arm assembly 530 and locater pin mount assembly 532. A description of the remainder of the apparatus 510 may be found above with the description of the apparatus 10 and the apparatus 210 and will not be repeated here.

The locater arm assembly 530 generally includes a pair of upper mounting blocks 540 that are configured to be fixedly mounted to the swing arm 535. In other examples, the mounting blocks 540 can be additionally or alternatively fixedly mounted to the cylinder mounting block 544. A punch assembly 546 can extend from the mounting block 544. A corresponding pair of locating arms 548 extends from the upper mounting blocks 540 and extends generally on opposing sides of the punch assembly 546. The locating arms 548 define terminal workpiece engaging surfaces 550. As will be described herein, the terminal workpiece engaging surfaces 550 of the locating arms 548 are configured to engage and therefore position a workpiece collectively referred to at 560. The workpiece 560 can generally include any workpieces that are to be joined such as a first workpiece 562 and a second workpiece 564 as shown in FIG. 20.

The locater pin mount assembly 532 generally includes a pair of lower mounting blocks 566 that are fixedly mounted relative to a die support 568. A die body 570 can be mounted to the die support 568. A pair of mounting arms 572 extends from the lower mounting blocks 566 and includes a corresponding pair of locater pins 576 extending generally upright therefrom. The locater pins 576 can include a generally conical and pointed tip 578. The locater pins 576 extend generally on opposing sides of the die body 570.

In the closed and working configuration shown in FIG. 20, the conical portions 578 of the locater pins 576 can be configured to extend through corresponding apertures formed in the first workpiece 562 and second workpiece 564. The terminal workpiece engaging surfaces 550 of the respective locating arms 548 can engage the second (or upper) workpiece 564 to permit the proper geometric orientation of a single workpiece or multiple workpieces during a joining operation. The locating pins 576 can be accurately positioned at desired locations on the workpiece 560 such as with a laser to qualify the apparatus 510 as a gauge such that the first and second workpieces 562 and 564 can be properly aligned to each other or to another subassembly. It will be appreciated that the locater arm assembly 530 and/or the locater pin mount assembly 532 can be configured as part of any of the other clinch-type clamp apparatuses 10, 210, and 410 described above.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. An apparatus for clinching a workpiece, the apparatus comprising:

a clamp body;

an arm rotatably fixed to the clamp body around a first pivot axis between a closed position and an open position;

a clinching punch mounted to one of the body and the arm;

a clinching die fixedly mounted to the other of the body and the arm; and a first linear actuator having a rod that selectively translates relative to a fluid-powered cylinder, the rod being rotatably coupled to the arm around a second pivot axis and configured to move between a first position corresponding to the arm being in the closed position and a second position corresponding to the arm being in the open position, wherein a first distance is defined between the first and second pivot axes in the closed position and a second distance is defined between the first and second pivot axes in the open position, wherein the first and second distances are equivalent;

wherein the first position of the rod corresponds to the rod being extended relative to the cylinder of the first linear actuator and the second position of the rod corresponds to the rod being retracted relative to the cylinder of the first linear actuator.

2. The apparatus of claim 1 wherein the arm generally comprises an arcuate body having a first body portion that extends between a first end and the first pivot axis and a second body portion that extends between the second end and the first pivot axis.

3. The apparatus of claim 2 wherein the first end of the arm includes one of the punch and die and the second end of the arm includes an engagement member that is configured to contact a portion of the clamp body when the arm rotates to the closed position.

4. The apparatus of claim 3, further comprising a second linear actuator that has a movable member that moves between a retracted position and an extended position, wherein in the extended position the movable member is aligned for contact with the second end of the arm and inhibits rotation of the arm around the first pivot axis toward the open position during operation of the punch.

5. An apparatus for clinching a workpiece, the apparatus comprising:

a clamp body;

an arm rotatable fixed to the clamp body around a first pivot axis between a closed position and an open position;

a clinching punch mounted to one of the body and the arm;

a clinching die fixedly mounted to the other of the body and the arm; and a first linear actuator having a rod that selectively translates relative to a fluid-powered cylinder, the rod being rotatably coupled to the arm around a second pivot axis and configured to move between a first position corresponding to the arm being in the closed position and a second position corresponding to the arm being in the open position, wherein a first distance is defined between the first and second pivot axes in the closed position and a second distance is defined between the first and second pivot axes in the open position, wherein the first and second distances are equivalent;

wherein the rod is rotatably coupled to the arm at a pivot joint that comprises a rod eye rotatably mounted about a pivot pin supported by a clevis extending from the arm.

6. The apparatus of claim 5 wherein the pivot joint further comprises a bronze bushing disposed between the pivot pin and the rod eye.

7. An apparatus for clinching a workpiece, the apparatus comprising:

a clamp body;

an arm rotatably fixed to the clamp body around a first pivot axis between a closed position and an open position;

a clinching punch mounted to one of the body and the arm;

a clinching die fixedly mounted to the other of the body and the arm; and a first linear actuator having a rod that selectively translates relative to a fluid-powered cylinder, the rod being rotatably coupled to the arm around a second pivot axis and configured to move between a first position corresponding to the arm being in the closed position and a second position corresponding to the arm being in the open position, wherein a first distance is defined between the first and second pivot axes in the closed position and a second distance is defined between the first and second pivot axes in the open position, wherein the first and second distances are equivalent;

wherein the punch and die are configured to produce a clinch joint on the workpiece.

8. The apparatus of claim 7 wherein the workpiece comprises sheets of material and wherein the die comprises a movable set of die blades which are operable with the punch to form and then expand a displaced portion of the sheets of material whereby the sheets of material are securely joined together.

9. An apparatus for clinching a workpiece, the apparatus comprising:

a clamp body;

an arm rotatably fixed to the clamp body around a first pivot axis between a closed position and an open position;

a clinching punch mounted to one of the body and the arm;

a clinching die fixedly mounted to the other of the body and the arm; and a first linear actuator having a rod that selectively translates relative to a fluid-powered cylinder, the rod being rotatably coupled to the arm around a second pivot axis and configured to move between a first position corresponding to the arm being in the closed position and a second position corresponding to the arm being in the open position, wherein a first distance is defined between the first and second pivot axes in the closed position and a second distance is defined between the first and second pivot axes in the open position, wherein the first and second distances are equivalent;

wherein the first linear actuator is rotatably fixed to the body about a third pivot axis and wherein the linear actuator rotates around the third pivot axis during translation of the rod between the first and second positions.

10. The apparatus of claim 1 wherein relative movement between the linear actuator and the arm at the pivot joint is without camming.

11. The apparatus of claim 5 wherein the first position of the rod corresponds to the rod being extended relative to the cylinder of the first linear actuator and the second position of the rod corresponds to the rod being retracted relative to the cylinder of the first linear actuator.

12. The apparatus of claim 1 wherein the clamp body comprises bifurcated support arms and wherein the rotatably fixed arm is rotatably positioned intermediate opposite arms of the bifurcated support arms.

13. The apparatus of claim 1 wherein the first linear actuator extends at a non-orthogonal angle relative to a clamp base that supports the clamp body in the first position.

14. The apparatus of claim 1, further comprising:

an anti-rotation block fixedly coupled to the arm, the anti-rotation block having first opposing flats formed theron configured to cooperate with complementary second flats formed on the clinching punch.

15. An apparatus for clinching a workpiece, the apparatus comprising:

a clamp body;

an arm rotatably fixed to the clamp body around a first pivot axis between a closed position and an open position;

a clinching punch mounted to one of the body and the arm;

a clinching die fixedly mounted to the other of the body and the arm; and a first linear actuator having a rod that selectively translates relative to a fluid-powered cylinder, the rod being rotatably coupled to the arm around a second pivot axis and configured to move between a first position corresponding to the arm being in the closed position and a second position corresponding to the arm being in the open position, wherein a first distance is defined between the first and second pivot axes in the closed position and a second distance is defined between the first and second pivot axes in the open position, wherein the first and second distances are equivalent;

a locater arm assembly extending from the arm and having a pair of locating arms extending generally on opposing sides of the clinching punch, the pair of locating arms having terminal engaging surfaces configured to engage and position a workpiece relative to the clinching die.

16. The apparatus of claim 15, further comprising:

a locater pin mount assembly extending from the die support and having a pair of locater pins that extend generally on opposing sides of the clinching die, the pair of locater pins having conical portions configured to extend through the workpiece and position the workpiece relative to the clinching die.

17. An apparatus for clinching a workpiece, the apparatus comprising:

a clamp body;

an arm rotatably fixed to the clamp body around a first pivot axis between a closed position and an open position, the arm including an arcuate body having a first body portion that extends between a first end and the first pivot axis and a second body portion that extends between the second end and the first pivot axis, wherein the arm includes an engagement member that is configured to contact a portion of the clamp body when the arm rotates to the closed position;

a clinching punch mounted to one of the body and the arm;

a clinching die fixedly mounted to the other of the body and the arm;

a first linear actuator having a rod that selectively translates relative to a cylinder, the rod being rotatably coupled to the arm around a second pivot axis and rotatably fixed to the body about a third pivot axis, the rod configured to move between a first position corresponding to the arm being in the closed position and a second position corresponding to the arm being in the open position; and a second linear actuator that has a movable member that moves between a retracted position and an extended position, wherein in the extended position the movable member is aligned for contact with the second end of the arm and inhibits rotation of the arm around the first pivot axis toward the open position during operation of the punch.

18. The apparatus of claim 16 wherein the first linear actuator rotates around the third pivot axis during translation of the rod between the first and second positions, wherein a first distance is defined between the first and second pivot axes in the closed position and a second distance is defined between the first and second pivot axes in the open position, wherein the first and second distances are equivalent.

19. The apparatus of claim 17 wherein the first linear actuator extends at a non-orthogonal angle relative to a clamp base that supports the clamp body in the first position.

20. The apparatus of claim 17, further comprising:

an anti-rotation block fixedly coupled to the arm, the anti-rotation block having first opposing flats formed theron configured to cooperate with complementary second flats formed on the clinching punch.

21. An apparatus for clinching a workpiece, the apparatus comprising:

a clamp body;

an arm coupled to the clamp body at a first pivot axis rotating between a closed position and an open position, the arm including an arcuate body having a first body portion that extends between a first end and the first pivot axis and a second body portion that extends between the second end and the first pivot axis;

a metal-working punch mounted to one of the body and the arm;

a metal-working die fixedly mounted to the other of the body and the arm;

a first fluid-powered actuator including a rod that linearly translates relative to a fluid-cylinder, the rod being rotatably coupled to the arm adjacent a second pivot axis and rotatably coupled to the body adjacent a third pivot axis, the rod moving between a first position corresponding to the arm being in the closed position and a second position corresponding to the arm being in the open position; and a second actuator operably moving a lock-out key between a retracted position and an extended position, wherein in the extended position the lock-out key is aligned for contact with the second end of the arm to inhibit rotation of the arm around the first pivot axis toward the open position during operation of the punch.

22. The apparatus of claim 21 wherein the first actuator rotates around the third pivot axis during translation of the rod between the first and second positions, wherein a first distance is defined between the first and second pivot axes in the closed position and a second distance is defined between the first and second pivot axes in the open position, wherein the first and second distances are equivalent.

23. The apparatus of claim 21 wherein the first linear actuator extends at a non-orthogonal angle relative to a clamp base that supports the clamp body in the first position.

24. The apparatus of claim 21, further comprising:

an anti-rotation block coupled to the arm and having first opposing flats theron configured to contact with complementary second flats formed on the punch which is a clinching punch.

25. The apparatus of claim 21, wherein the second actuator includes a fluid-cylinder and a piston.

26. The apparatus of claim 21, wherein the arm moves by linear activation of the first actuator and without camming.

27. The apparatus of claim 21, further comprising a locater arm assembly extending from the arm and having a pair of locating arms extending generally on opposing sides of the punch, the pair of locating arms having terminal engaging surfaces configured to engage and position a sheet-metal workpiece relative to the die.

28. The apparatus of claim 5 wherein the arm comprises an arcuate body having a first body portion that extends between a first end and the first pivot axis and a second body portion that extends between the second end and the first pivot axis, and the apparatus further comprising a second linear actuator including a movable member that moves between a retracted position and an extended position, wherein in the extended position the movable member is aligned for contact with the second end of the arm and inhibits rotation of the arm around the first pivot axis toward the open position during operation of the punch.

29. The apparatus of claim 5 wherein the workpiece comprises sheets of material and wherein the die comprises a movable set of die blades which are operable with the punch to form and then expand a displaced portion of the sheets of material such that the sheets of material are securely joined together.

30. The apparatus of claim 5 wherein the first linear actuator is rotatably fixed to the body about a third pivot axis and wherein the linear actuator rotates around the third pivot axis during translation of the rod between the first and second positions.

31. The apparatus of claim 5, further comprising a locater pin mount assembly extending from the die support and having a pair of locater pins that extend generally on opposing sides of the clinching die, the pair of locater pins having conical portions configured to extend through the workpiece and position the workpiece relative to the clinching die.

32. The apparatus of claim 7 wherein the arm comprises an arcuate body having a first body portion that extends between a first end and the first pivot axis and a second body portion that extends between the second end and the first pivot axis, and the apparatus further comprising a second linear actuator including a movable member that moves between a retracted position and an extended position, wherein in the extended position the movable member is aligned for contact with the second end of the arm and inhibits rotation of the arm around the first pivot axis toward the open position during operation of the punch.

33. The apparatus of claim 7 wherein the first linear actuator is rotatably fixed to the body about a third pivot axis and wherein the linear actuator rotates around the third pivot axis during translation of the rod between the first and second positions.

34. The apparatus of claim 7, further comprising a locater pin mount assembly extending from the die support and having a pair of locater pins that extend generally on opposing sides of the clinching die, the pair of locater pins having conical portions configured to extend through the workpiece and position the workpiece relative to the clinching die.

35. The apparatus of claim 7, further comprising an anti-rotation block fixedly coupled to the arm, the anti-rotation block having first opposing flats formed theron configured to cooperate with complementary second flats formed on the clinching punch.

36. The apparatus of claim 9 wherein the arm comprises an arcuate body having a first body portion that extends between a first end and the first pivot axis and a second body portion that extends between the second end and the first pivot axis, and the apparatus further comprising a second linear actuator including a movable member that moves between a retracted position and an extended position, wherein in the extended position the movable member is aligned for contact with the second end of the arm and inhibits rotation of the arm around the first pivot axis toward the open position during operation of the punch.

37. The apparatus of claim 9 wherein the workpiece comprises sheets of material and wherein the die comprises a movable set of die blades which are operable with the punch to form and then expand a displaced portion of the sheets of material such that the sheets of material are securely joined together.

38. The apparatus of claim 9 wherein relative movement between the linear actuator and the arm at the pivot joint is without camming, wherein the first position of the rod corresponds to the rod being extended relative to the cylinder of the first linear actuator and the second position of the rod corresponds to the rod being retracted relative to the cylinder of the first linear actuator.

39. The apparatus of claim 9, further comprising an anti-rotation block fixedly coupled to the arm, the anti-rotation block having first opposing flats formed theron configured to cooperate with complementary second flats formed on the clinching punch.

40. The apparatus of claim 9, further comprising a locater pin mount assembly extending from the die support and having a pair of locater pins that extend generally on opposing sides of the clinching die, the pair of locater pins having conical portions configured to extend through the workpiece and position the workpiece relative to the clinching die.

41. The apparatus of claim 15 wherein the arm comprises an arcuate body having a first body portion that extends between a first end and the first pivot axis and a second body portion that extends between the second end and the first pivot axis, and the apparatus further comprising a second linear actuator including a movable member that moves between a retracted position and an extended position, wherein in the extended position the movable member is aligned for contact with the second end of the arm and inhibits rotation of the arm around the first pivot axis toward the open position during operation of the punch.

42. The apparatus of claim 15 wherein the workpiece comprises sheets of material and wherein the die comprises a movable set of die blades which are operable with the punch to form and then expand a displaced portion of the sheets of material such that the sheets of material are securely joined together.

43. The apparatus of claim 15 wherein the first linear actuator is rotatably fixed to the body about a third pivot axis and wherein the linear actuator rotates around the third pivot axis during translation of the rod between the first and second positions.

* * * * *